US005964178A

United States Patent [19]

Gonda

[11] Patent Number: 5,964,178

[45] **Date of Patent: *Oct. 12, 1999**

[54] COLLAPSIBLE BOAT WITH ENHANCED RIGIDITY AND MULTI-FUNCTION CHAIR

[76] Inventor: Raymond M. Gonda, 10 Cardinal Woods, South Burlington, Vt. 05403

[ * ] Notice: This patent is subject to a terminal disclaimer.

[21] Appl. No.: 08/930,881

[22] PCT Filed: Jun. 6, 1996

[86] PCT No.: PCT/US96/09023

§ 371 Date: Sep. 30, 1997

§ 102(e) Date: Sep. 30, 1997

[87] PCT Pub. No.: WO96/39323

PCT Pub. Date: Dec. 12, 1996

Related U.S. Application Data

[63] Continuation-in-part of application No. 08/471,851, Jun. 6, 1995, Pat. No. 5,615,634, and application No. 08/477,992, Jun. 7, 1995, Pat. No. 5,622,403.

[51] Int. Cl.[6] ..... B63B 7/06; A47C 9/00

[52] U.S. Cl. ..... 114/354; 114/363; 114/347; 297/25; 297/423.46; 297/19

[58] Field of Search ..... 114/347, 354, 114/363; 297/19, 22, 25, 54, 423.46, 195.11, 195.1, 202, 215.1

[56] References Cited

U.S. PATENT DOCUMENTS

| | | | |
|---|---|---|---|
| 1,685,599 | 9/1928 | Fletcher . | |
| 1,987,851 | 1/1935 | Holman | 155/142 |
| 1,989,146 | 1/1935 | Ogden, Jr. | 155/177 |
| 2,053,755 | 9/1936 | Wilcox | 114/354 |
| 2,671,231 | 3/1954 | Massicotte | 114/347 |
| 2,962,732 | 12/1960 | Marz | 9/2 |
| 2,994,891 | 8/1961 | Przyblski | 9/2 |
| 3,049,731 | 8/1962 | Ertl et al. | 9/2 |
| 3,599,257 | 8/1971 | Erickson | 114/347 |
| 4,030,487 | 6/1977 | McEachran | 128/24.1 |
| 4,184,281 | 1/1980 | Corby et al. | 43/57 |
| 4,290,157 | 9/1981 | Jensen, Jr. | 9/2 C |
| 4,503,799 | 3/1985 | Masters | 114/363 |
| 4,768,459 | 9/1988 | Cerkvenik et al. | 114/363 |
| 5,615,634 | 4/1997 | Gonda | 114/354 |
| 5,622,403 | 4/1997 | Gonda | 297/19 |

*Primary Examiner*—Sherman Basinger
*Attorney, Agent, or Firm*—Hayes Soloway Hennessey Grossman & Hage PC

[57] ABSTRACT

A collapsible portable boat with enhanced rigidity, comprising a main skeleton frame and hull, including an end stem section and gunwales connected to each other by a gunwale connecting means, further characterized in that the hull is of flexible material, a floor section affixed to that portion of the hull section which defines the bottom of the boat and which is disposed between the stringers and the flexible material of the hull, characterized in that the skeleton frame comprises a plurality of support stringers running the length of the boat along the bottom and sides of said boat, including support formers arranged transverse to said lengthwise support stringers, characterized in that the support stringers themselves comprise a plurality of short sectional support elements which are affixed to one another by means for maintaining tension between said short sections, and a means for developing tension between said skeleton structure and the outer flexible hull positioned between the flexible material of the hull and the skeleton, characterized in that the tension substantially prevents longitudinal hull flex.

34 Claims, 24 Drawing Sheets

Fig. 9a
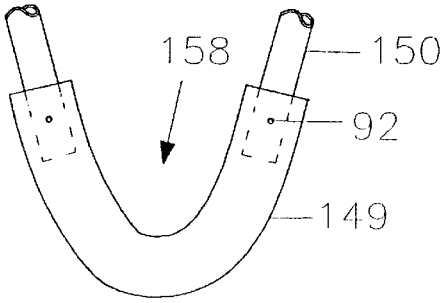
Fig. 9b
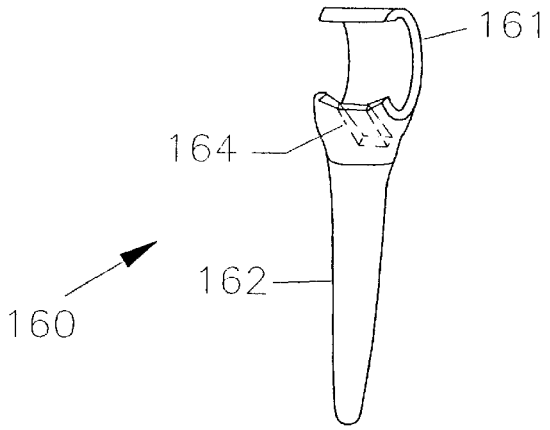
Fig. 9c
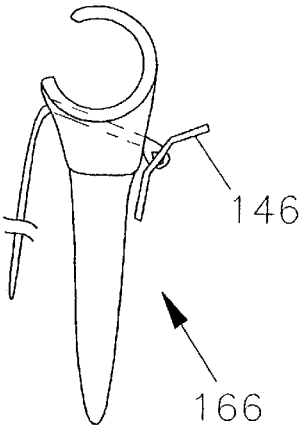
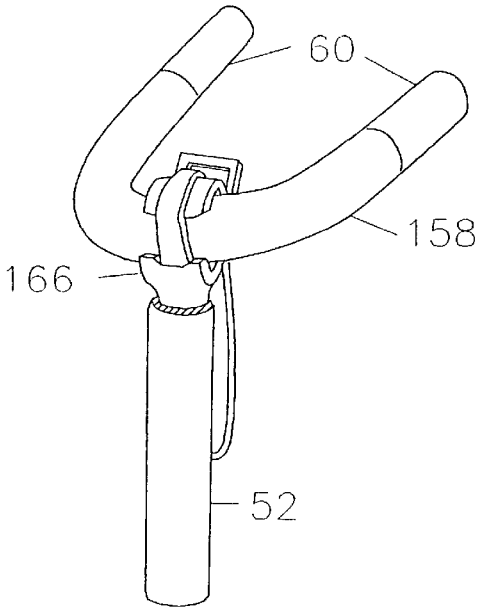
Fig. 9d

Fig. 9.1a
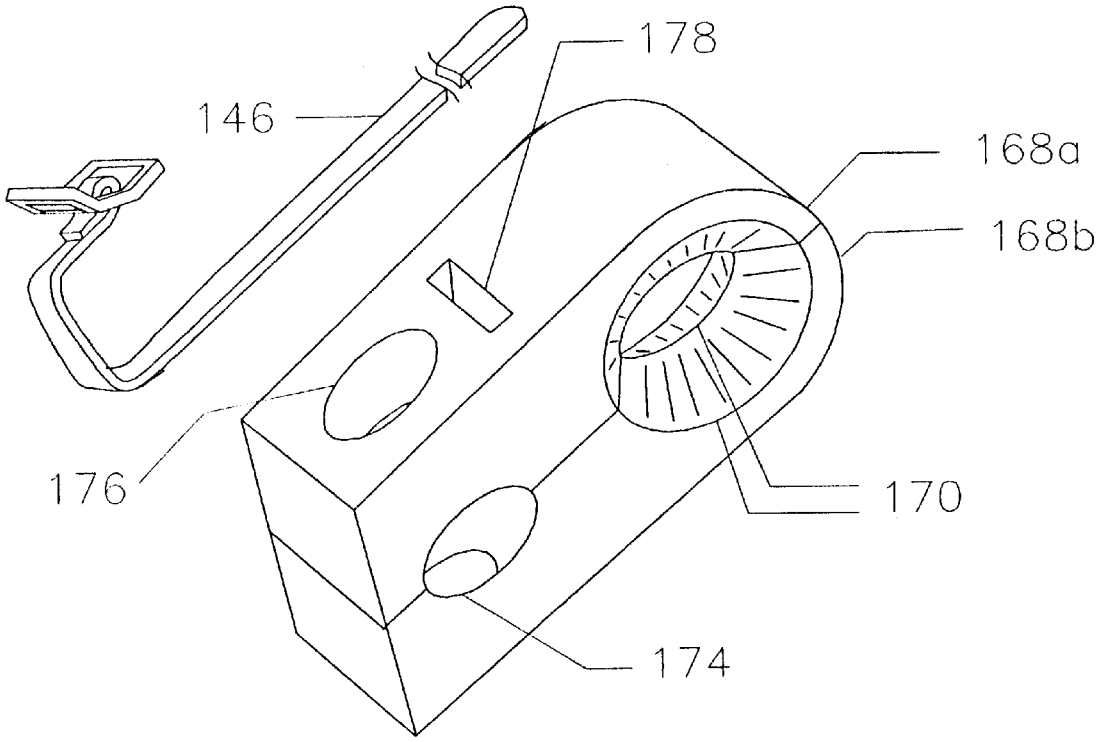
Fig. 9.1b
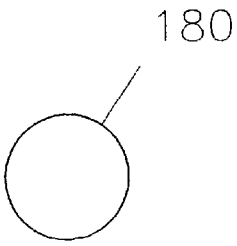
Fig. 9.1c
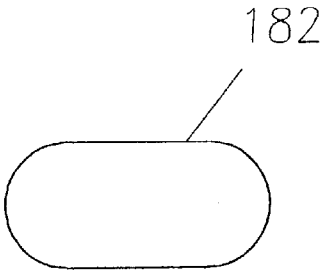

Fig. 9.1d
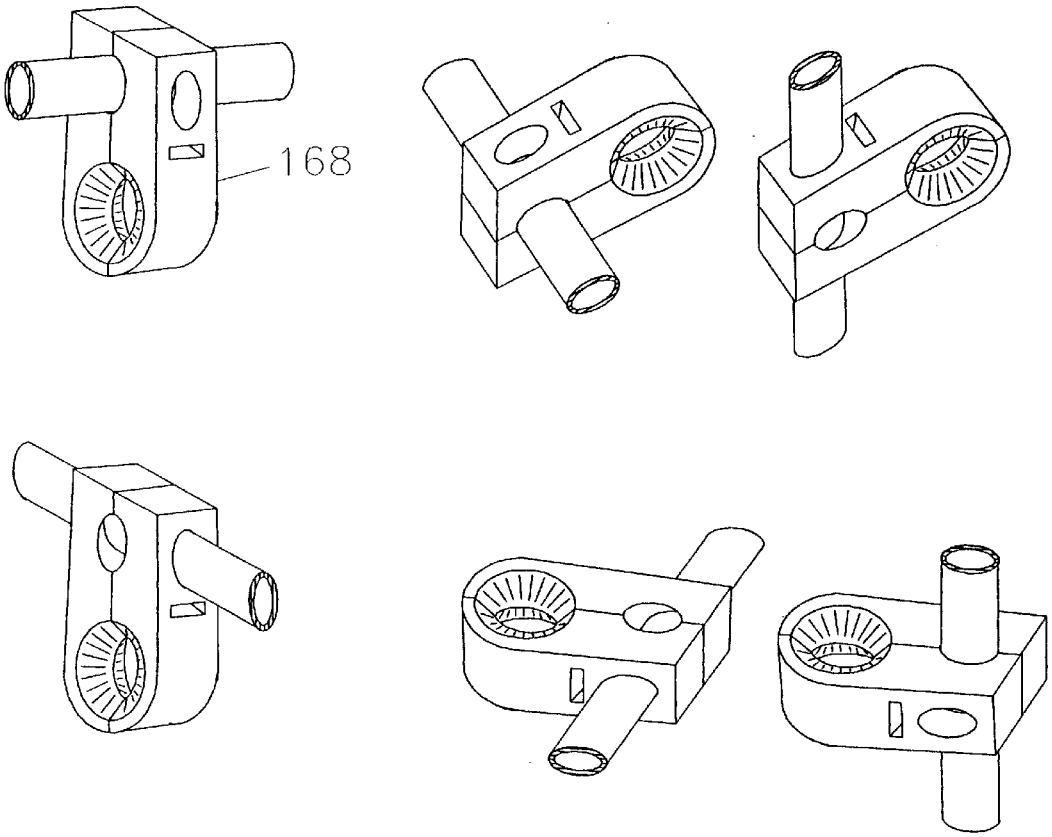
Fig. 9.1e
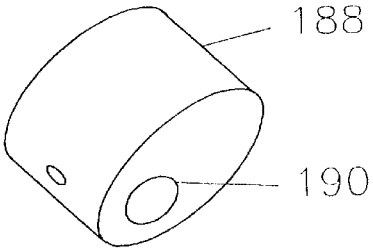
Fig. 9.1f
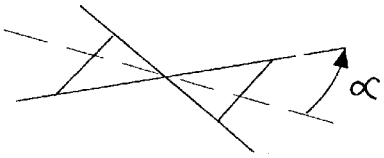
Fig. 9.1g
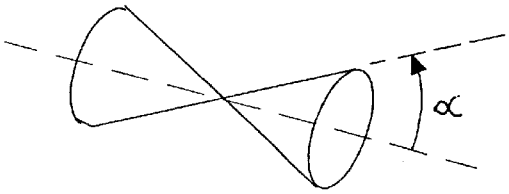

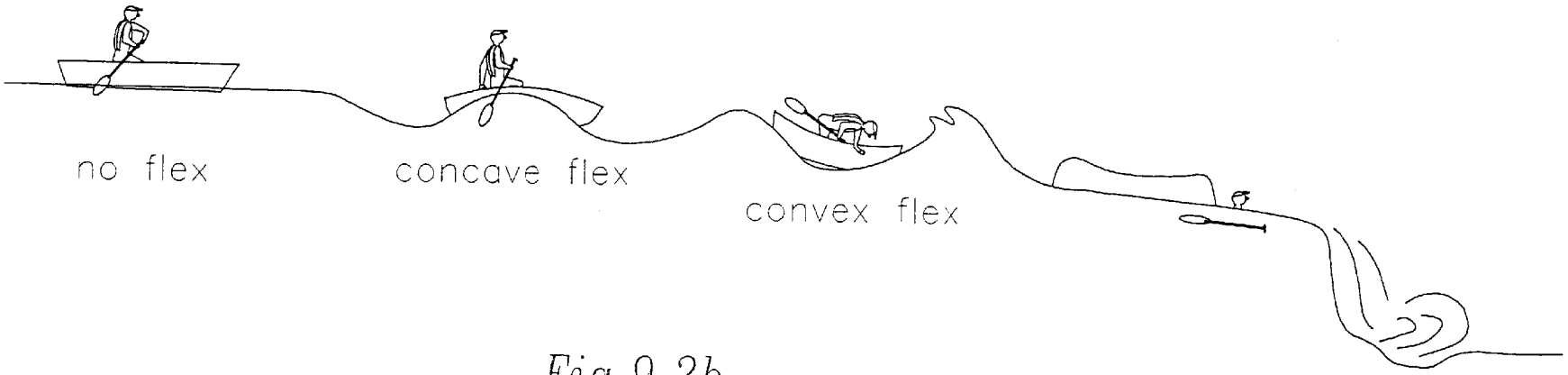
Fig. 9.2a
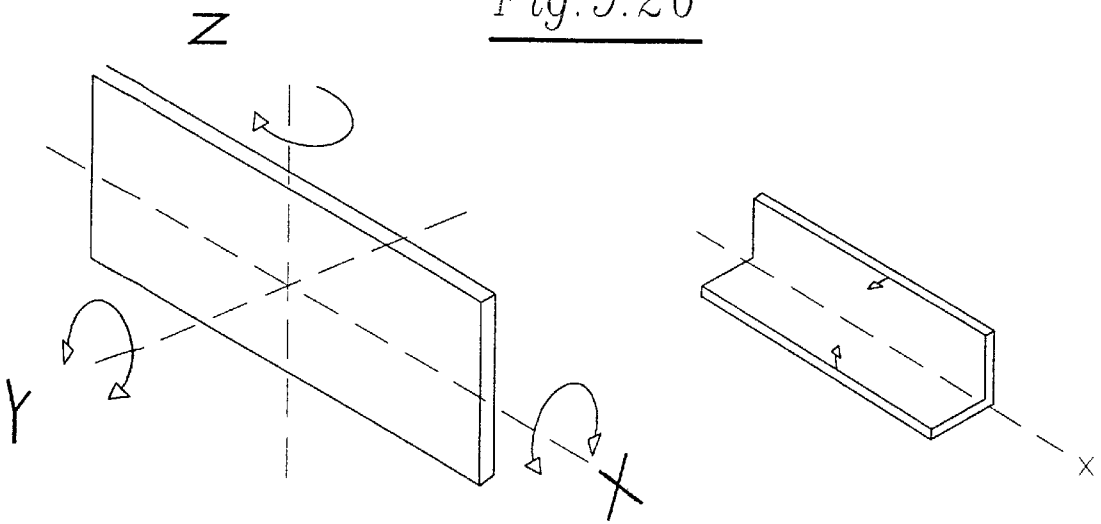
Fig. 9.2b

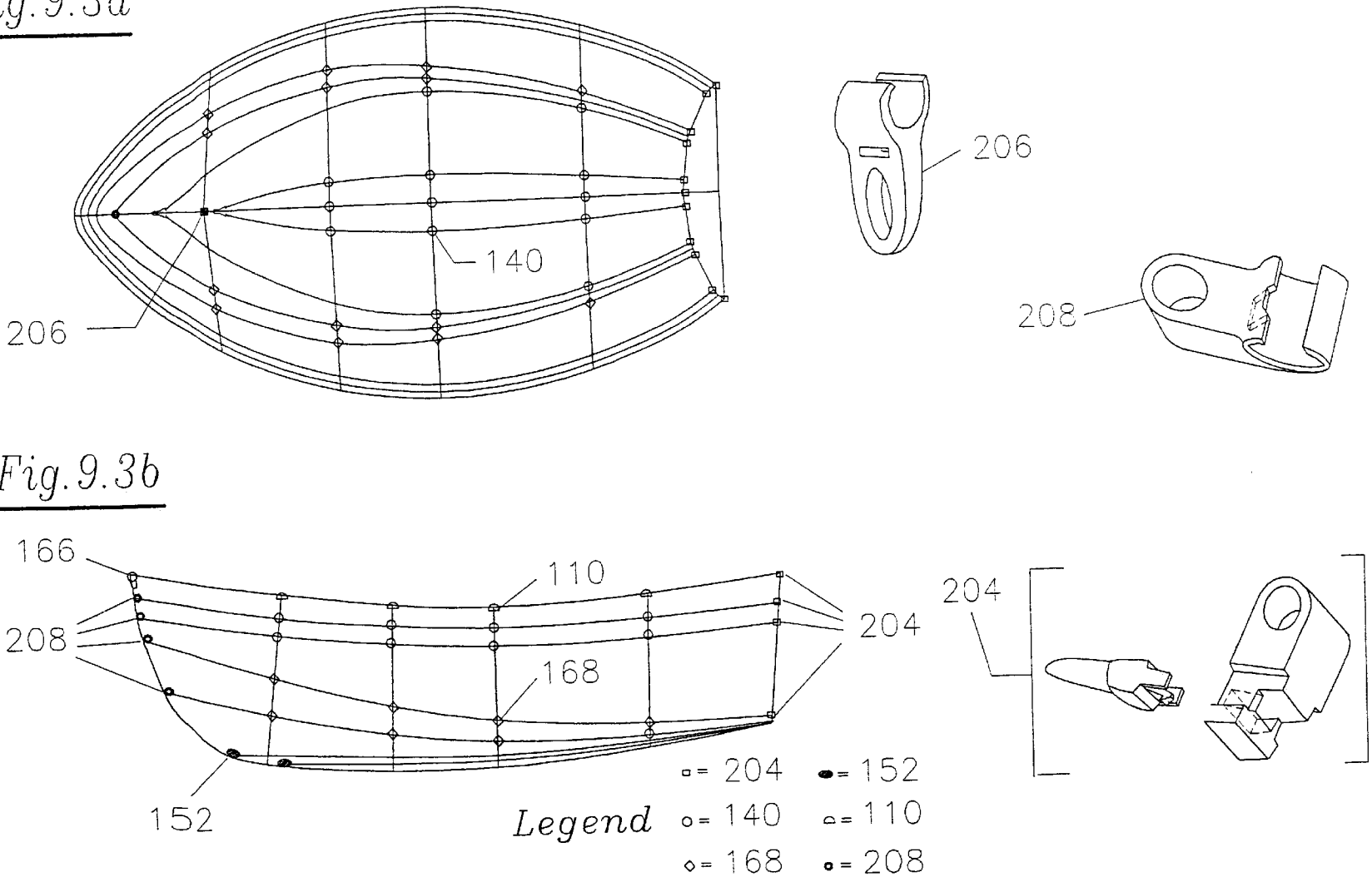
Fig. 9.3a
Fig. 9.3b

*Fig. 9.4a*
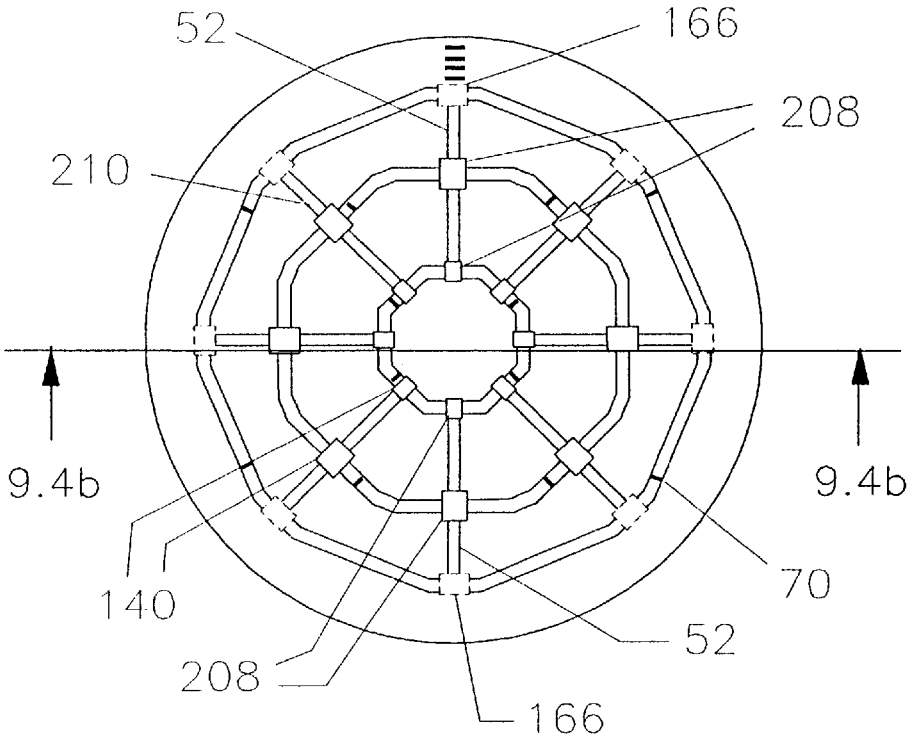
*Fig. 9.4b*
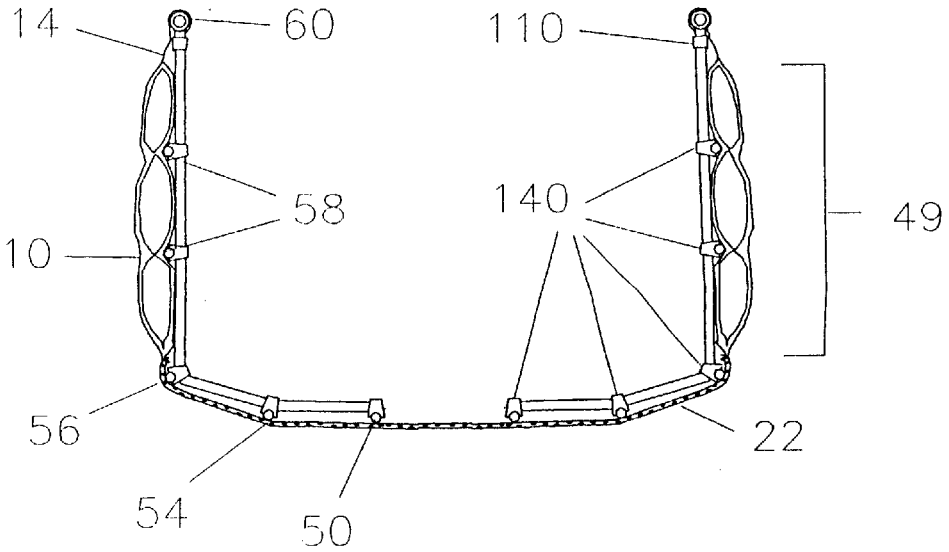

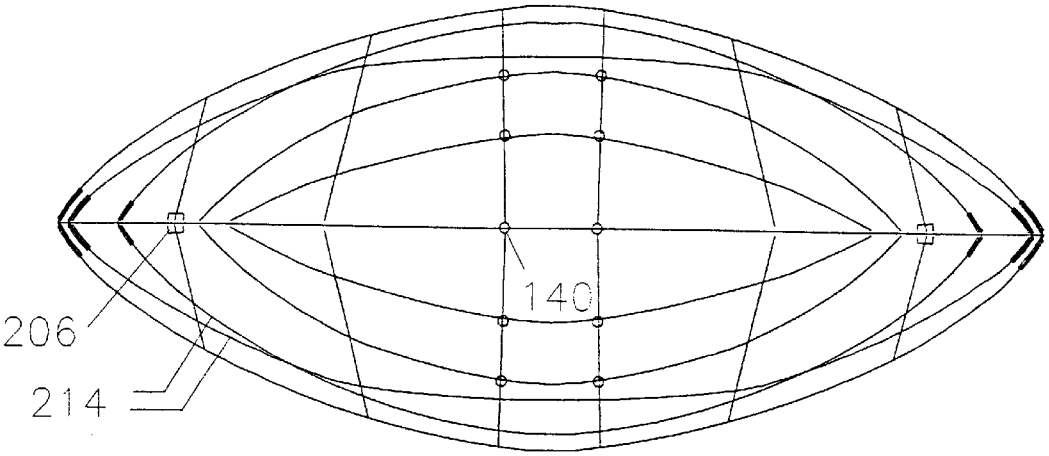
Fig. 9.5a
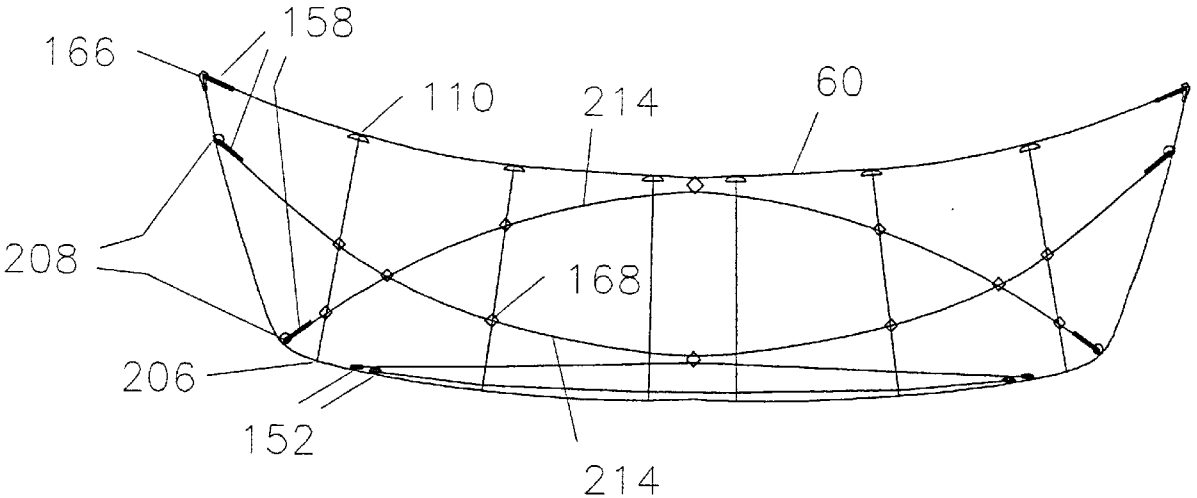
Fig. 9.5b
Legend
• = 152
○ = 140
◇ = 168
– = 110

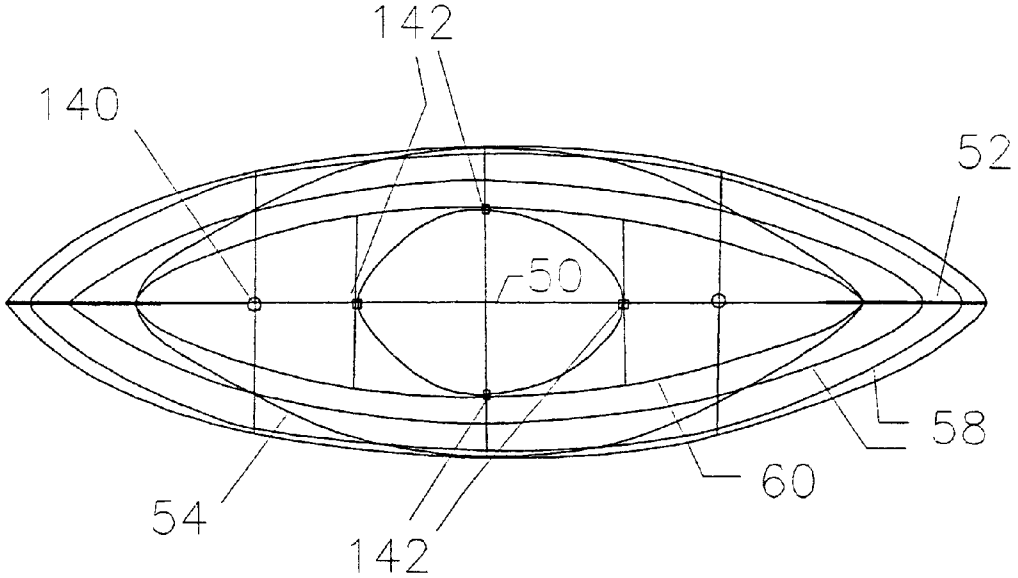
Fig. 9.6a
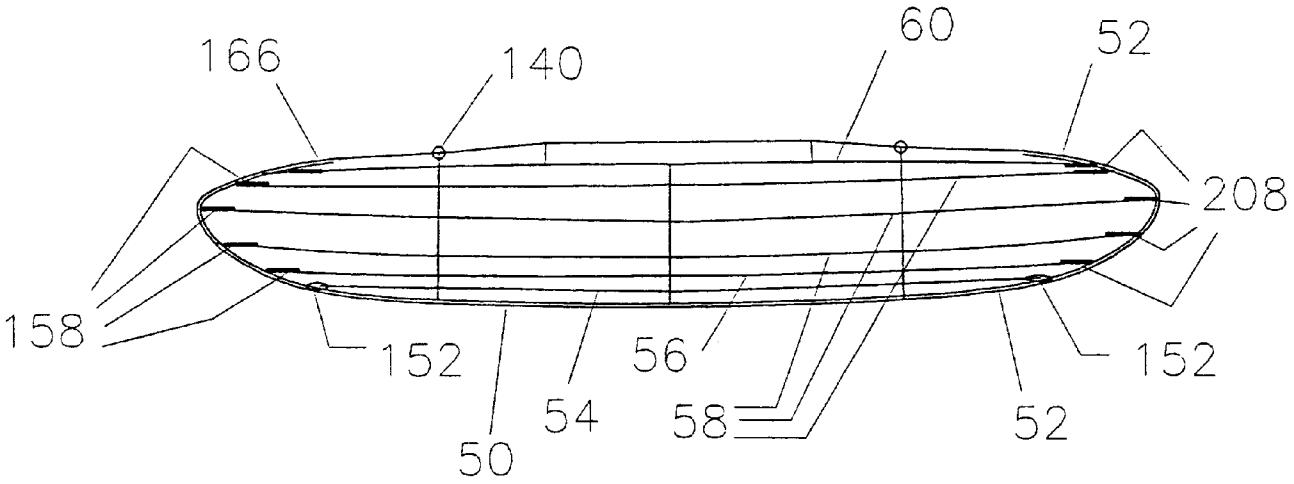
Fig. 9.6b

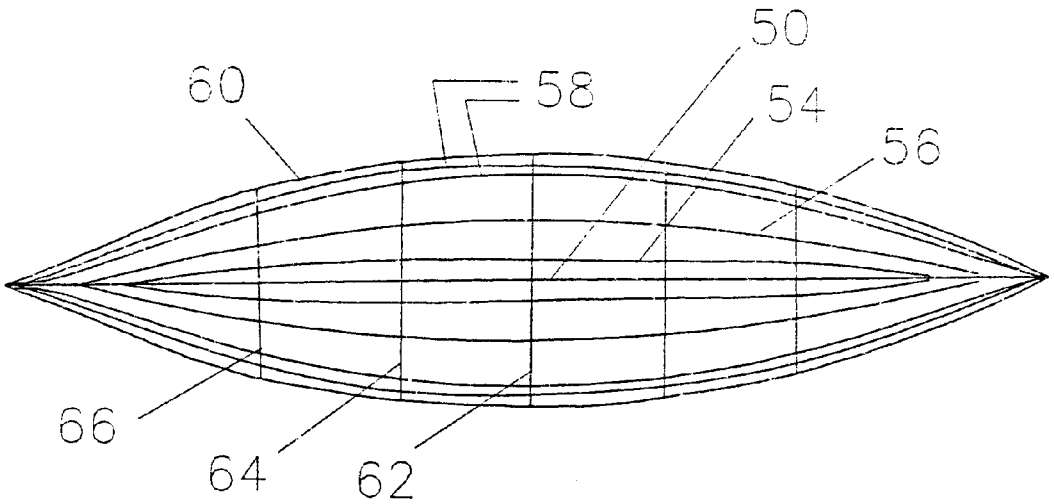
Fig. 9.7a
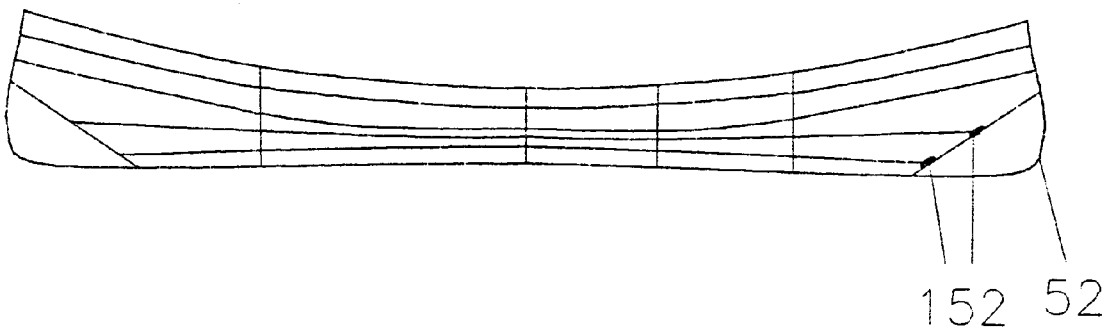
Fig. 9.7b

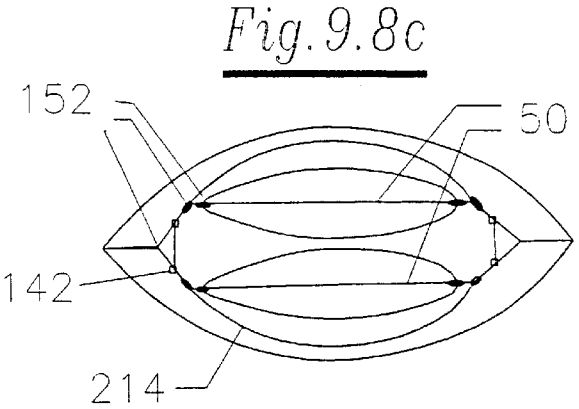
Fig. 9.8c
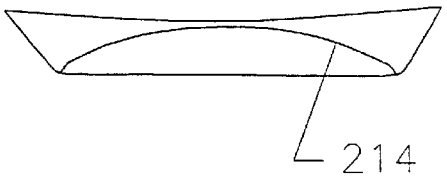
Fig. 9.8d
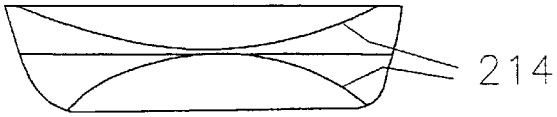
Fig. 9.8f
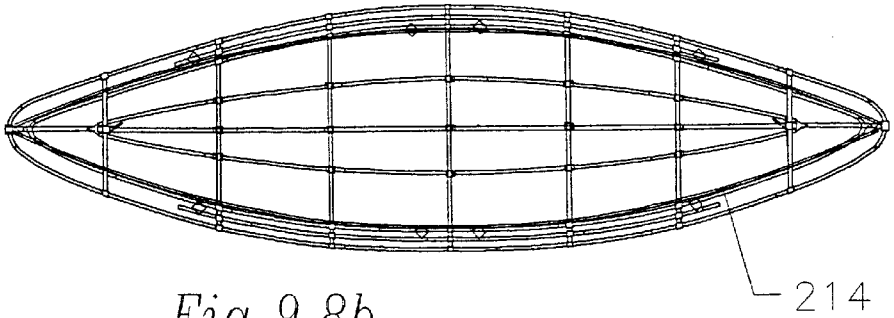
Fig. 9.8a
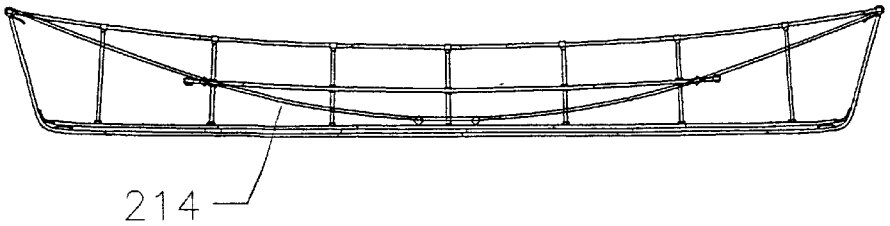
Fig. 9.8b
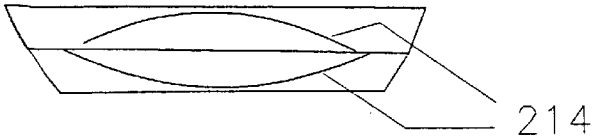
Fig. 9.8e

COLLAPSIBLE BOAT WITH ENHANCED RIGIDITY AND MULTI-FUNCTION CHAIR

This is a continuation-in-part of Ser. No. 08/471,851 filed Jun. 6, 1995, now U.S. Pat. No. 5,615,634 and Ser. No. 08/477,992 filed Jun. 7, 1995, now U.S. Pat. No. 5,622,403.

FIELD OF THE INVENTION

The present invention relates to a design system for building folding boats with flexible hull skins, and more particularly to a lightweight, collapsible, easily transportable, easy-to-assemble canoe, with a structurally secure skeleton and a built-in flotation. In addition, the present invention also relates to a canoe chair or seat that is generally flat-folding, portable, adjustable, ergonomically designed, multi-position, and multi-function which adapts to sitting and kneeling positions, and which can be adjusted for use as a portage yoke.

BACKGROUND OF THE INVENTION

Boats with skin or skin-like hulls have been made and used from before recorded history in North America and other areas of the world. In North America, these range from the usually umbrella-or hemispherically-shaped bull boats of the Plains Indians, constructed from buffalo skins stretched over a framework of saplings, or the skin of moose stretched over a rowboat-like framework of small trees by Indians of Athabascan stock in Northwestern Canada, to kayaks made from walrus skins stretched over whale rib bones by Eskimos of the polar regions. Folding boats have been patented on both the North American and Eurasian Continent for more than a century. Although at least one commercially successful folding canoe is on the market, most commercially successful folding watercraft are kayaks.

Open canoes and kayaks represent the extreme ends of a range or continuum of hull forms. The open canoe's hull is open all along the top, while the hull of the kayak completely envelopes the craft except for the cockpit opening of the paddler. In the middle of this range, canoes and kayaks are difficult to distinguish from each other. Since the middle of this century, some canoes have been fitted with a cover or a deck of rigid material, as an integral part of the canoe, making them difficult to distinguish from kayaks. This is particularly true of slalom racing canoes and kayaks.

For an observer, the method of propulsion and posture of the paddler in the boat is the most reliable indication of whether the boat is a canoe or a kayak. The primary method of propulsion of a canoe is by a single-bladed paddle with the canoeist either sitting erect with feet flat on the floor ahead of the paddler or tucked beneath or beside the paddler's seat. The primary method of propulsion of a kayak is through use of a double-bladed paddle with the kayaker sitting close to or on the floor of the kayak with feet and legs extended in front. A solo canoeist may choose to use a double bladed paddle at times with increased paddling comfort and effectiveness on flat water, but conversely, it is anatomically difficult to use a single-bladed paddle and be effective at propelling a kayak.

Rowboats present a different type of craft primarily in the way in which they are propelled. They are equipped with oar-locks and use oars. However, many canoes are rigged for rowing as are some types of kayaks. So the distinction here is again one more of posture of the paddler or rower than the boat itself as to how to classify it.

Mimicking the general design of the native North American birchbark canoes, modern open canoes are structured using a watertight skin covering that can be either rigid, semi-rigid or flexible as one of the components of the hull. The definition of the hull is somewhat arbitrary but is presumed to be the entire structure exclusive of the seats, thwarts, gunwales, and other things which are detachable from the craft. It is normally considered to comprise two parts, a skeletal structure inside to create hull rigidity, and a covering over it to keep the water out, i.e., the skeleton and the skin. It may or may not contain longitudinal ribs called stringers in a folding canoe, and cross-ribs called formers in a folding canoe, depending on the stiffness, strength, and rigidity of the skin.

If the hull skin is pre-formed and of sufficient strength and stiffness, it may contain no skeleton. Examples of this are open canoes made of a heat formed laminate referred to by brand names as Royalex or Oltonar, and of plastics such as cross-linked polyethylene. If the skin of an open boat is a fabric coated for abrasion resistance and waterproofness, such as canvas, or is made of aluminum, or fiberglass, it will more often contain a skeleton to give shape and rigidity to the hull in open boats.

However, in most open boats horizontal transverse members called thwarts are present which attach between opposing gunwales to maintain the transverse spacing of the gunwales and provide lateral strength to the boat and assist in maintaining the overall shape and rigidity of the hull.

At least one inflatable open canoe containing no solid rigid members anywhere in its structure is commercially available, but it has the serious disadvantage of being heavy, about half again or twice as heavy as the present invention of an equivalent size and load-carrying capacity, and it is not comfortable to be in for long periods of time. Many brand names and models of inflatable kayaks currently on the market, best know to laypersons as "rubber duckies", likewise aren't well- suited for use for long periods of time. The problem with these self-bailing inflatables is that the seat is too close to the floor for proper sitting comfort hour after hour. An inefficient and anatomically uncomfortable paddling position while sitting is the trade-off for achieving a self-bailing canoe.

The established advantages of flexible canoes are primarily advantages relative to hard-hulled boats. They are as follows:

1) Light weight.
2) Soft hull which reduces damage to other equipment such as car or truck roofs when transporting.
3) Soft hull and fewer exposed hard surfaces or fittings to cause damage to hands, fingers, toes or other limbs if the craft is accidentally dropped.
4) Easily transportable and easily stored in minimal space.
5) Packaging capability facilitates commercial transport on public transportation such as buses, trains and airplanes.
6) Hull skin materials provide insulation from cold water.
7) Soft skinned hull material is the quietest of all materials when scraping or bumping rocks or other below or above water solid objects.
8) When the boat is pinned in a broach situation, the flexibility of the hull provides greater capability to free the craft from the pinned position than that of hard hulled boats.
9) A person pinned and trapped by the boat, in a potentially life or bodily harm threatening situation, may more readily be freed by the ability of the hull skin material to be cut with an ordinary knife increasing the chance of freeing the victim. With hard hulled boats this potential is minimal or does not exist.

10) The lightness, and the softness of the hull materials of a flexible boat make it easier to manage and recover by a swimmer in a capsize situation. This is particularly advantageous when capsized in a rapids. It reduces the chance of injury because of the absence of hard inflexible surfaces such as are present in hard-hulled boats.

11) The hull yields under shock, which may reduce damage to it, and which allows improved control in turbulent water.

12) The flexibility in the hull assists in maintaining a drier boat, i.e., it ships less water, by somewhat conforming to the shape of waves rather than slicing through them.

13) A folding canoe has the advantage over other folding craft such as kayaks of remaining assembled for the duration of the paddling season, stored, and used like any other canoe. It provides a less expensive transport solution for day trips. It is transportable as are other canoes by means of inverting it over a pair of straight barred roof racks and tied down without requiring disassembly of the boat. Specially built roof rack adapters are not required. It can, as other folding craft such as canoes and kayaks, be checked as extra luggage on commercial air flights.

Shortcomings of the current state of the art of commercially successful collapsible boats using internal framework with a flexible hull skin are best understood by the currently most successful of these, the folding canoes disclosed by Jensen in U.S. Pat. No. 4,290,157. Other folding canoes which exist or have been attempted are similar to the Jensen technology. The three principal problems cited by users of these craft, which are each major problems, built using this technology are 1) the hull has too much flex in it, 2) the skeleton is not structurally sound, and 3) the canoe becomes heavy and unmanageable in use by water getting trapped under the floor foam. Other problems of a more peripheral nature, also present, will be discussed hereinbelow.

As noted, structural rigidity remains a problem in the prior art. If, in an otherwise empty canoe, a solo paddler sits in the middle, the ends rise out of the water creating more rocker. The hull acquires convex flex. It's shape becomes that of a banana boat, a term given to highly rockered canoes. It makes the boat highly maneuverable, i.e., easy to turn. If two tandem paddlers sit at the ends of the boat, one at each end, the center of the boat rises as the ends sink deeper into the water creating an concave hull with inverse rocker, like an upside down banana, which makes the boat less maneuverable. This creates boat handling problems and is not conducive to continued structural integrity of the canoe in turbulent water conditions. Limited flexibility is an advantage, too much flexibility is a disadvantage. To date no-one has been able to strike the necessary balance.

Moreover, the longer the canoe the more pronounced the problem. It becomes significantly noticeable in the 15 foot model but becomes a problem in the 16.5 foot model for both a solo paddler positioned at the center of the canoe and for tandem paddlers positioned toward the ends of the canoe. In the 18 foot model it is a serious problem, which, when taken together with the other structural problems present in the prior art, compromises the viability of these longer canoes with experienced whitewater and wilderness paddlers. The hulls are too flexible in the longitudinal direction limiting maneuverability and contributing to poorer structural integrity.

Part of this problem is obvious and part is not obvious. The obvious part is when a paddler's foot, while seeking a secure hold in the bottom of the canoe, presses against the cross-rib or former, it can become dislodged from its placement within the skeletal structure. A user solution to this common problem is to reinforce the connections with segments of nylon cord tied around the stringers and formers where they intersect. The other problem is the lack of a secure connection of the former to the gunwale. The design of both the connector fastening the former to the floor stringers and with the connectors which fasten the former to the gunwale has not provided for effective security. Neither are secure connections. These connector designs often require multiple attempts for successful assembly by the user at the onset of a trip.

In addition, the structural tubular frame skeleton of the canoe is not self-supporting and relies on interaction with the hull skin to maintain structural integrity, and often partially disassembles in actual field use and abuse, which is typical of the conditions to which such craft are exposed. The need to lock gunwales to the formers is not obvious because in, e.g., the Jensen design, the hull skin is an integral component in the system to maintain skeletal integrity. The compression placed downward on the gunwale connectors by the skin via the gunwales is critical, by design, or otherwise, to maintain the connectors in place on the gunwales.

This reliance on tension in the skin, to maintain structural integrity of the skeleton, is a problem which needs to be solved if structural integrity is to be maintained during operational conditions which cause mechanical stress on the canoe, i.e., either from the hydraulic action of water in a swamped and out-of-control canoe, a boat rescue situation after a capsize, a canoe's being pinned or broached on some in-stream obstruction, or a water laden canoe being maneuvered down a rapids, bumping and scraping underwater obstructions.

Water entrapment under the foam floor causes increased weight and loss of operational maneuverability and manageability, and is an ever-present problem in prior art designs. The foam in the floor of the canoe is not attached to or otherwise integrated with the hull skin which causes water to creep under the foam and the fabric, making the canoe heavier, more difficult to maneuver, and more likely to disassemble in use because of the above-stated problems with its skeleton. Having that happen in the middle of a raging rapids, with a boat laden with camping gear miles from the nearest road, may be dangerous to the occupants of the canoe. It is annoying to a day use recreational paddler.

Other problems which are important but not as serious are: a) the foam in the bottom of the boat rather than on the sides makes it more difficult to upright a capsized boat. It is of marginal value when trying to maintain control of a swamped boat and may actually hamper such efforts because of its position placement in the canoe, b) gunwale terminators and connectors consist of too many small easy-to-misplace parts, c) in spite of claims to the contrary, a rubber hammer and small wrench are required to assemble and maintain an assembled canoe, and d) the seat does not fold nor easily accommodate a kneeling paddler, and e) there is no carrying or portage yoke system available.

As is clear from the above, to date, in spite of their numerous advantages over hard-hulled craft, and although adequate to serve the general purposes they were designed for, most folding watercraft still do not have sufficient credibility among experienced users to become a major contender as a boat of choice.

When considering boats with flexible hull skins, post the era of the aboriginal skin boats, collapsible boats, comprising stringers, formers, a keel and gunwales in various arrangements in sectional break down form, have a rich history. This is particularly true in North America around the turn of the last century and later in this century. Portable, collapsible, or folding boats disclosed in U.S. Pat. Nos. 598,989, 833.846, and 2,053,755 have had shortcomings such as a keel made specifically of gas pipe, too many loose parts, easy-to-lose small parts, complicated rib connections with ferrules and auxiliary ribs. All are time consuming to assemble. More recently a kayak disclosed in U.S. Pat. No. 3,869,743 uses a sliding fastener as a means to insert the skeleton into the hull skin. It boat does not implement hull-flex reduction measures.

Some of the collapsible boats use air sponsons or air bladders in the sides. An early boat disclosed in U.S. Pat. No. 507,439 suffers the usual shortcomings of too many parts to lose and features air sponsons in the floor and sides with no claims and no description of function or purpose for them. A collapsible boat disclosed in U.S. Pat. No. 2,338,976 uses air sponsons in the sides of the hull for tensioning the skin, for flotation, and for transverse shock absorption. The hull stiffening comes from the skeletal structure alone in the description. A rowboat and motorboat are described. Focusing on preventing securing joints for connecting side sponsons from disintegrating in collapsible kayaks, it is disclosed in U.S. Pat. No. 3,049,731 how to secure a single-chambered sponson to the each side by suspension from the deck. It does not mention the purpose of the sponsons. A challenge craft disclosed in U.S. Pat. No 4,961,397 employs sponsons for skin tensioning but makes a questionable claim that the sponsons contribute to craft stability. In a collapsible canoe disclosed in U.S. Pat. No. 4,751,889, air sponsons, in the side, are stated to be for the purposes of skin tensioning and buoyancy.

As can be seen, therefore in the prior art no disclosure has been made of air sponsons or bladders being used to serve the purpose of reducing flex in the hull for increased boat handling performance in collapsible, or folding boats, containing an internal hull-shaping skeletal framework.

In a collapsible boat design, disclosed in U.S. Pat. No. 3,070,816, a gunwale terminator is present integrated into the skeletal structure by a specific fastening system. However, the formers are mounted to the gunwales without a fastening device to lock the two together.

A fastener or buckle, disclosed in U. S. Pat. No. 5,311, 649, used commonly for securing straps on backpacks and belts and similar devices, requires two fingers to release, one finger placed on each of the two opposing sides of the buckle. It is not directly applicable for adaptation as a connector in a folding boat. At times connectors in large mechanical objects such as folding canoes need more than the human hands to disengage the locking mechanisms due to mechanical stresses which may tend to unavoidably bind or restrict the connection in some way. For example, as a matter of reality and practicality in a field situation, a tool, such as the end of a pointed wooden sapling, may be needed in such cases to a release the locking mechanism. This would be difficult-to-impossible using the Suk-type releasing mechanism. Also the positioning of the releasing mechanisms in opposition to each other may inhibit access to the unlocking mechanism because of purely physical positioning reasons. both of the locking mechanism on the fastener, and because of the location of the fastener within the skeleton of a folding boat.

The car-seat belt buckle, disclosed in U.S. Pat. No. 4,502,194, operates with a different locking mechanism than the buckle cited above. It contains a spring which would be subject to binding and seizing, due to invasion of sand or other debris into the locking mechanism, if implemented in a canoe which is continually subjected to the elements of water, weather and debris.

A connector system for construction of roofs, disclosed in U.S. Pat. No. 381,137 for connecting purlin and rafters to roofing requires solid rigid bolt as a securing device. A clamping device disclosed in U.S. Patent No. 1,920,130 for clamping together pipes, rods, cables, ropes and for other purposes requires a retaining screw to secure. A retaining clip, disclosed in U.S. Pat. No. 3,004,370, for right angle connections, requires sheet metal for its construction, and its action depends on teeth present on the jaws of the device to flex then return with biting, a clamping action which damages the target member. A connecting clip for joining concrete reinforcing rods, disclosed in U.S. Pat. No. 4,110, 951, is not adjustable for various retaining angles, i.e., various angles of repose. A pipe clasper, disclosed in U.S. Pat. No. 3,932,049, is not itself securable in position on its mounting member. None of the preceding connectors allows for a wide variety of connecting angles, and, in general, all are meant to remain permanently in position once installed. This does not suit the purposes of a collapsible portable watercraft.

A folding Dinghy, as disclosed in U.S. Pat. No. 4,124, 910, folds but doesn't disassemble.

It is an object of the present invention to overcome the disadvantages of the prior art and provide a collapsible canoe or folding boat that has an enhanced rigidity that is fully adjustable, thereby providing performance more typical of a non-collapsible watercraft.

It is also the object off this invention to provide, in connection with the preparation of a folding boat, a structural configuration which allows for said rigidity, while at the same time providing ease of construction and assembly, in a substantially portable configuration.

It is also a specific object of the invention to provide the enhanced structural integrity in a folding boat by incorporation of a novel boat skeleton, optionally in the presence of an antiflex air-bladder system and/or attached floor.

It is also a specific object of the invention to provide enhanced resistance to longitudinal hull flex by incorporation of antiflex air-bladder system and optionally by novel boat skeleton elements in the presence or absence of said antiflex air-bladder system.

The present invention describes structure and methodology to build a variety of flexible-hulled folding boats such as open canoes, kayaks, bull boats, dinghies, and rowboats. Such craft, among many others, are included within the scope of this invention. The present invention is a set of individual improvements, such when present together, give a synergistic overall effect sufficient to place a boat made from this technology into a new generation of folding boats. The ease of extension of this technology to folding boats other than canoes, gives the totality of these improvements the characteristics of a design system. The basic embodiment discussed is a canoe. The shape of the present basic embodiment of the invention is typical of many modem canoes of a popular design and can best illustrate the implementation of a specific design using the system. However, radically different alternate embodiments are briefly described later in the section on scope-of-the-invention to illustrate the breadth of the potential applications of the system. These alternate embodiments include additional canoe designs and other types of watercraft.

The advancements and improvements of the present invention over prior art in a basic embodiment of a folding canoe are as follows:

1. Antiflex Air-bladder System.

The implementation of the air-bladder with cover system as per the present invention functions most importantly to add a variable amount of additional stiffening to the hull of the canoe. This has not been successfully addressed in any of the prior art kayaks and canoes and is a great improvement over prior art. It also has the benefit, present in most air-bladder or sponson prior art designs of making the canoe much easier to assemble and disassemble. The air-bladders are inflated after the skeleton and skin are assembled thus bringing the skin into tension and snugging it against the already assembled skeleton.

The amount of flex in the hull can be adjusted by the amount of stiffening introduced by controlling the air pressure in the air-bladders. A solo paddler in white water rapids might want less stiffening to increase maneuverability. A pair of tandem paddlers in the same boat might want higher air pressure with its increased hull stiffening to counteract the tendency of the ends of the canoe to sink deeper in the water under the action of their weight and their position at the ends of the canoe.

The air-bladder, as side-flotation, provides for greatly increased stability when swamped with water, which helps maintain the paddler in controlling the canoe, thereby diminishing the likelihood of capsize and extending the opportunity to get to safety with the craft. It provides for enhanced recovery capability in a near capsize situation when a gunwale has dipped below the surface of the water, because the flotation along the sides of the canoe, now being under and surrounded by water, tends to force the gunwale back toward the surface.

Contrary to the claims of some folding kayak companies the flotation in the sides of a kayak, the sponsons, do not reduce the likelihood of capsize when no water is present in the kayak. In a upright kayak, side sponsons add stability when the craft is water laden, as it does in a canoe. However, it is no less likely to capsize, than a kayak without sponsons which has the same outer hull shape and dimensions, as the kayak with sponsons. The gunwale on a kayak is essentially the cockpit rim. Hence, it is evident that a kayak has already capsized if its cockpit rim has dipped below the level of the water. Then it's too late for side sponsons to prevent capsize.

The antiflex cover provides the key function of anchoring the air-bladder to the hull skin to aid in the transfer of the stiffness of the air-bladder to the hull of the canoe; and it offers protection to the air-bladders from trapped debris and water. It also protects it from the sun's ultraviolet light, from abrasion, and from air-leakage from small punctures. It thus prolongs the life of the bladders. It eliminates inconveniences for the paddler since water and debris have no place to collect to require cleaning while afield. The removable air-bladders are easy to repair in the field with minimal repair materials.

Although the side stringers are not directly part of the antiflex system, they are of importance in helping hold the antiflex-system in the proper orientation for maximum effectiveness. This allows the antiflex system to have its greatest impact at reducing hull flex. The side stringers thus play a dual role since they also directly improve the structural rigidity of the isoskeleton itself.

The air-bladder assists in giving superior structural strength to the canoe in pin and broach situations and makes it likelier that the canoe will be rescued rather than destroyed.

2. The Isoskeleton and its Building Blocks.

If an air-bladder were to be punctured, the tension in the skin, which is the securing means for holding the gunwales to the formers, would be released. Due to the design of the prior art connectors, the former then would be subject to lateral stress which could dislodge the two mating elements of the connector since there is no laterally locking action on this type of connector. This can happen, even with the skin still in tension, in prior art.

A solution to the problem of formers disconnecting from the stringers, due to inadequately locking connectors, is to modify the existing connector design in order to give a more secure, though not isotropically secure, connection. For example, simply enhancing the same style of connector employed to latch more firmly without significantly altering the overall shape or mechanism for locking action. This might suffice to prevent the formers from accidentally being dislodged from a stringer by a paddler's foot inadvertently pressing against it, one of the main causes of unintended disconnection in prior art canoes; but, it would not solve the problem of a lack of overall isotropic skeletal security in mechanically stressful circumstances. Any approach, short of locking the formers to both the gunwales and the stringers with isotropic security, is inadequate to solve the structural integrity problem.

The elements of the present invention solve both the problems described above. The isoconnectors, and lockconnectors, provide both rotationally and translationally secure connections. Taken together with the gunwale terminator fasteners, they provide the means whereby the skeleton achieves structural integrity and isotropic security over prior art folding canoes. They do not rely on the hull skin to maintain the structural integrity of the skeleton. The isoconnectors provide for isotropically secure locking of formers to stringers. The lockconnectors assure that the gunwales remain locked to the formers, and the gunwale terminators and fasteners assure that the stems are locked securely to the gunwales. With these improvements state of the art is advanced to isotropically secure skeletons.

This is of key importance in the event a side air bladder becomes deflated from puncture. Flat air-bladders won't cause the skeleton to disassemble in the canoe constructed per the present invention. If the air-bladders both become punctured when the canoe is out on a choppy ocean with no hope of reaching shore any time soon, or in the middle of a long rapid on a large river, the paddler can be assured that the canoe will continue to retain its skeletal integrity and can continue to be paddled until safe haven is reached for repair. An isotropically secure skeleton is also important if the canoe becomes pinned or broached on an obstacle in a current. It eliminates the likelihood that the boat will disassemble in situations short of the outright fracture of the members themselves. This can spell the difference between a destroyed canoe and a salvaged canoe, and likewise a salvaged trip, and perhaps even salvaged personal safety. A structurally secure skeleton gives superior strength in such circumstances compared to prior art. All of these above concerns are met in the present invention.

Relative to prior art, the gunwale terminator design, method and position of fastening, and integration with the gunwales themselves enhances the esthetic appearance, as well as the structural integrity of the canoe, has fewer parts, and permits faster assembly of the canoe by the user. Solid terminators, integral with the gunwale, give breadth and flare to the bow and stern sections, increasing seaworthiness and ability to ride the waves with a reduced possibility of swamping. Solid terminators, integral with mid-stem mounted side-stringers, enhance the whitewater capability of a canoe by adding a controllable amount of flare to increase seaworthiness beyond that added by the gunwale terminators. Thus versatility in designing the bow and stern sections of the canoe is created in the present invention, which is missing in the prior art. The solid, rigid gunwale and side-stringer terminators enhance overall canoe rigidity when in use and when in capsize situations. The locking isoconnectors and lockconnectors make the canoe easier to assemble, since the locked parts do not slip back out of place while other parts of the boat are being assembled. This is a major problem in the prior art.

The isoconnector of the present design is closely related to prior art, but consists of fewer parts and is of a simpler design. It provides connecting functions in a different fashion, requiring one finger, rather than two, for release of the connection. This is an important consideration, when hands and fingers are too cold to function properly as might be true on many northern rivers. The flanges on the side of the male isoconnector serve a dual role of protecting the locking tab from fracture during transport and handling when not in the connected state, a further advantage over prior art.

When a former is being installed in the canoe, the channels on the male isoconnector comprise self-alignment guides for connecting with the female isoconnector. This simplifies and speeds water-side assembly for the user. These self-aligning isoconnectors also speed the stringers into the properly spaced-apart positions from each other. The self-alignment channels help retain the stringers in place after canoe assembly, an additional skeletal security feature. The flush face on both the male and the female isoconnector parts simplifies initial installation onto the stringers and formers by aligning with each other on a flat horizontal work surface. This saves initial assembly costs compared to prior art. The spacers and shockcords reduce the number of parts required when connecting stringers together and speeds the initial assembly of the stringers at the factory, both of which reduce manufacturing costs. The wing fasteners which connect the floor and the chine stringers to the stem have fewer parts than the prior art. A further advantage over prior art is that no tools are required for assembly of the canoe by the user.

The universal grasp connector of the present invention provides additional function and more versatility than prior art by being portable, adjustable, and by allowing a variety of connection configurations and connection angles to be realized.

3. Shockfloor.

One particular improvement to the hull skin over prior art, is attachment of the foam to the floor fabric of the canoe. Using a higher density foam than that used in prior art assures less permanent distortion of the foam by the stringers, and thereby assures a continued snug fit. Water will not get under foam to make the canoe heavy and unwieldy, as occurs in prior art folding canoes.

4. The Assembled Canoe and Handling Performance.

Some remarkable safety features are built into the canoe of the present invention. The task of recovering a canoe in a capsize situation is highly simplified by the high amount of lighter-than-water side-flotation present. When retrieving the canoe, turning it on its side creates a self-bailing situation in which the air-bladder in the side of the canoe, which is under water, forces the canoe toward the surface, emptying water as it rises. Then simply flipping the canoe upright yields a canoe nearly empty of water. This same feature also makes it easy and safer to accomplish a mid-stream re-entry of the canoe by a swimmer. Recovery from impending capsizes is improved by side-flotation. A new level of stability is introduced which transcends secondary stability since the chance to recover continues after the gunwale dips below the surface.

The flexible outer skin of the canoe and particularly the shock absorption provided by the air-bladder in the sides of the canoe allows the canoe to absorb more shock and impact from collisions with obstacles and from waves in turbulent water than hard-hulled canoes. The paddler of the soft-hulled canoe is better able to maintain control of the craft because of the reduction of the violent jarring action which is more emphasized in a hard-hulled boat. The soft-hulled craft handles more smoothly in violent water.

The shape of the bow provided by the gunwale terminator and side stringer terminator designs allow for designing broader bow and stern areas of the boat which creates more lift at the ends of the boat for surmounting waves. Enhanced skeletal rigidity, as distinguished from hull material softness, aids in canoe maneuverability and overall strength in a synergistic fashion when taken together with the antiflex-air-bladder system and the other elements of the skeleton in the canoe. Thus, with soft-hulled canoes and less hull flex, the average paddler finds an optimal trade-off with regard to boat manageability.

As a result of its lightness along with all of the above reasons, the characteristics of the canoe make it safer than prior art folding canoes and safer than hard-hulled canoes faced with similar circumstances of class of water, skill level of paddler, prevailing weather, level of safety precautions taken, and water turbulence, among other considerations. A paddler in control of his canoe is almost always safer than when out of control or when swimming a rapid. Running whitewater in any boat design entails risks to the occupants that no boat design can eliminate. However the canoe of the present invention enhances the chance that the paddler will remain in control of the canoe. Finally, the side flotation enhances ability to side-surf which constitutes a performance improvement and enhanced recreational capability.

5. Development of New Boat Models Using All or Parts of the Invention

Each of the sub-systems of the present invention are useful in designing alternate embodiments of boats. The various connectors and fasteners and their alternate embodiments taken together comprise a complete system of connectors and fasteners for fashioning a wide variety of hull shapes and forms and skeletal configurations.

In implementing the antiflex air-bladder system, the number of air chambers, and their lengths and diameters can be varied. Combined with some flexibility with their positioning in the boat, greater versatility is gained in modifying the shape of the hull of the boat. Alternate embodiments are easy to create by changing the shape of the stems, by where the various stringers are fastened to a stem, by the modifying the width of the gunwale and side stringer terminators, and by the number of stringers and formers used and by their locations. Some of the elements such as the stem may be absent, or a true keel may be absent, from alternate embodiments as in a bull boat. Some designs may have more than one keel such as in an alternate embodiment of a canoe to obtain a wider bottom.

The system provides an eloquent way to speed development of designs of new models from this technology, by enabling a skeleton to be connected piece by piece, while modifications are made to other parts of the emerging skeleton. The various embodiments of a strap fastener provides a means to rapidly adjust the position of a side stringer or other skeletal members. By raising or lowering the wings of a wing fastener, a means to alter the shape of keel line of the boat obtains by varying the elevation of floor or chine stringers above the floor of the canoe.

The grasp fastener breaks the restriction of requiring at least a 90 degree angle between two connected members, thereby allowing greater versatility in fastening configurations and broadening the range of skeletal structures possible.

In any boat designed with this system: The shockfloor may not be present or the shockfloor foam laminate may be located elsewhere in the boat than in the floor; the antiflex system may be present only in part or in total; a greater, or a lesser number of stringers may be present to create a wider, or a narrower or a deeper canoe; the relative positions and orientations of the stringers to each other may vary; the arrangement of attachments of formers to stringers, particularly at the ends of the canoe may vary; a greater, or a fewer number of formers and a varying number of thwarts may be present; a thwart or thwarts may be attached directly to the gunwales; a side stringer may not be present or additional ones may be present; lockconnectors may be replaced by isoconnectors; the stem may be absent as per the example of the bull boat, and in which the stringers close on themselves; in cases such as the dory, illustrated later in the section on the scope of the invention, the stringers may actually cross over each other to gain the desired hull shape and to provide less hull flex.

One major advantage of the elements and methodology of the invention and is that one does not rely on intermediate steps such as expensive molds or plugs which are necessary, for example, for constructing fiberglass plastic or hard-hulled laminated-skinned canoes. The development progresses directly from the design on paper to the building of the boat itself. The system can be used to rapidly develop prototype hull shapes at minimal expense, for building either folding boats or for prototypes to be cast ultimately in fiberglass, plastic, metal or other material. The cost of the tools to do the bending of the skeletal structures, and to do the sewing of the fabrics to create the skin, are all relatively low. The connectors to connect the elements of the skeletal structure are relatively low cost.

SUMMARY OF THE INVENTION

A collapsible portable boat with enhanced rigidity, comprising a main skeleton frame and hull, including an end stem section and gunwales connected to each other by a gunwale connecting means, further characterized in that the hull is of flexible material a floor section affixed to that portion of the hull section which defines the bottom of the boat and which is disposed between the stringers and the flexible material of the hull, characterized in that the skeleton frame comprises a plurality of support stringers running the length of the boat along the bottom and sides of said boat, including support formers arranged transverse to said lengthwise support stringers, characterized in that the support stringers themselves comprise a plurality of short sectional support elements which are affixed to one another by means for maintaining tension between said short sections, and a means for developing tension between said skeleton structure and the outer flexible hull positioned between the flexible material of the hull and the skeleton, characterized in that the tension substantially prevents longitudinal hull flex.

BRIEF DESCRIPTION OF THE DRAWINGS

FIG. 9*a* is a top view of a gunwale terminator.

FIG. 9*b* is a perspective view of a gunwale-terminator mount.

FIG. 9*c* is a side view of a gunwale-terminator fastener.

FIG. 9*d* is an fragmentary view of gunwales connected to a stem using the gunwale terminator shown in FIG. 9*a* and the gunwale-terminator fastener of FIG. 9*c*.

FIG. 91*a*–9.1*g* are a set of perspective views various ways of mounting a universal grasp connector for connector members at various angles.

FIG. 9.2*a* is an theory-of-operation illustration of the phenomenon of hull flex in a canoe.

FIG. 9.2*b* is an theory-of-operation illustration of the antiflex air-bladder system principle.

FIG. 9.3*a* is a top view of an isoskeleton of a dinghy as an alternate embodiment of the invention.

FIG. 9.3*b* is a side view of the isoskeleton in FIG. 9.3*a*.

FIG. 9.4*a* is s top view of an isoskeleton of a bullboat as an alternate embodiment of the invention.

FIG. 9.4*b* is a side view of the isoskeleton in FIG. 9.4*a*.

FIG. 9.5*a* is a top view of an isoskeleton of a drift boat or dory as an alternate embodiment of the invention showing antiflex members.

FIG. 9.5*b* is a side view of the isoskeleton in FIG. 9.5*a*.

FIG. 9.6*a* is a top view of an isoskeleton of a kayak as an alternate embodiment of the invention.

FIG. 9.6*b* is a side view of the isoskeleton in FIG. 9.6*a*.

FIG. 9.7*a* is a top view of an isoskeleton of a guide boat as an alternate embodiment of the invention.

FIG. 9.7*b* isoskeleton in FIG. 9.7*a*.

FIG. 9.8*a* is a top view of an alternate embodiment of the basic embodiment canoe modified by use of a single antiflex stringer in each side.

FIG. 9.8*b* is a side view of the canoe of FIG. 9.8*a*.

FIG. 9.8*c* is an alternate embodiment canoe of which employs a double keel for extra width, using bifurcated stems and a single antiflex stringer in each side.

FIG. 9.8*d* is a side view of the canoe in FIG. 9.8*c*.

FIG. 9.8*e* is a side view of a boat employing an alternate embodiment of a pair of antiflex stringers in each side of the boat.

FIG. 9.8*f* is a side view of a boat employing an alternate embodiment of a pair of antiflex stringers in each side of the boat.

DETAILED DESCRIPTION OF THE PREFERRED EMBODIMENTS

Figure 1A:
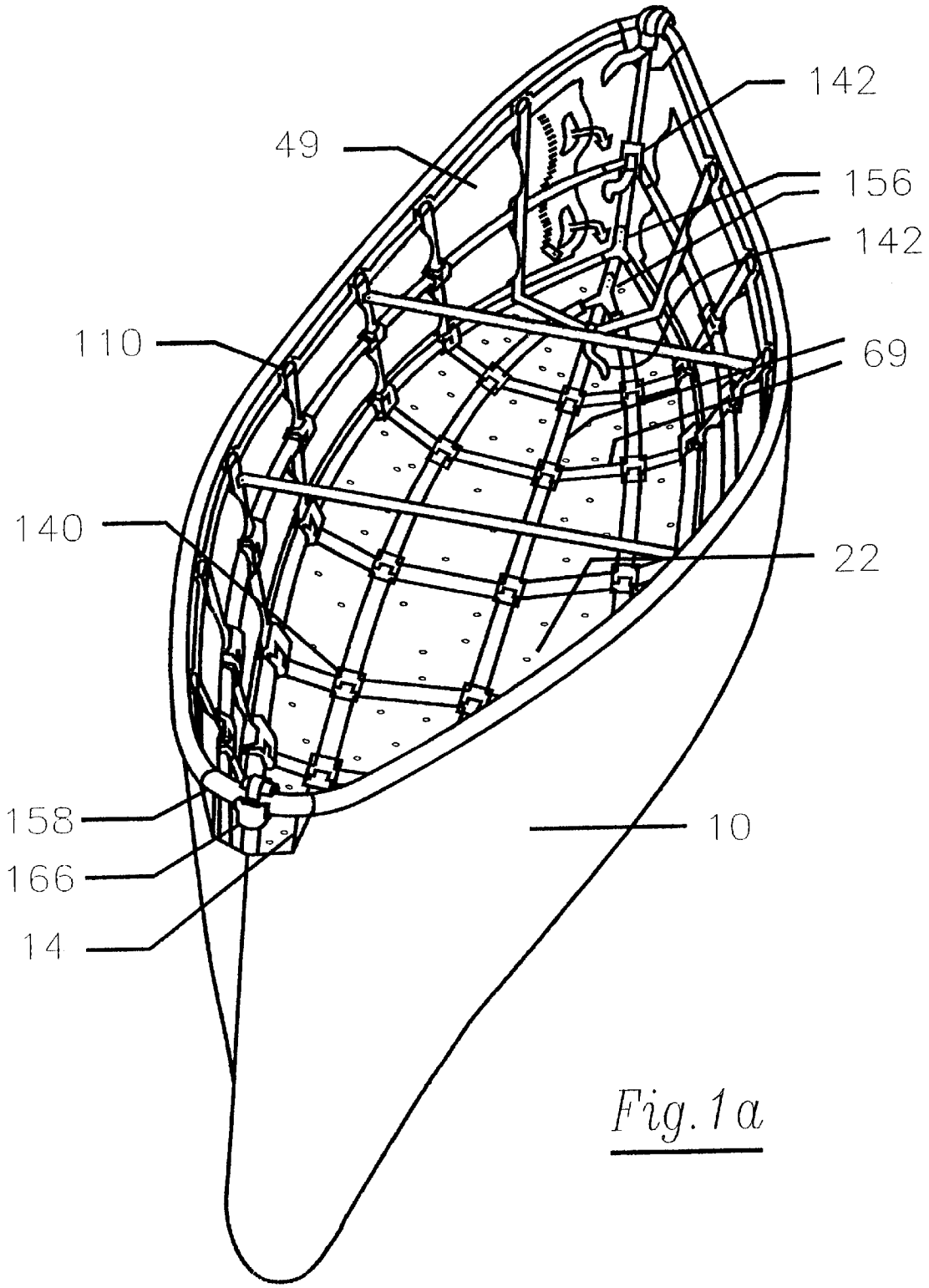
FIG. 1*a* is a perspective end view of a folding canoe with an isotropically secure skeleton and a hull-flex reduction and flotation air-bladder system as per the present invention.
Figure 1B:
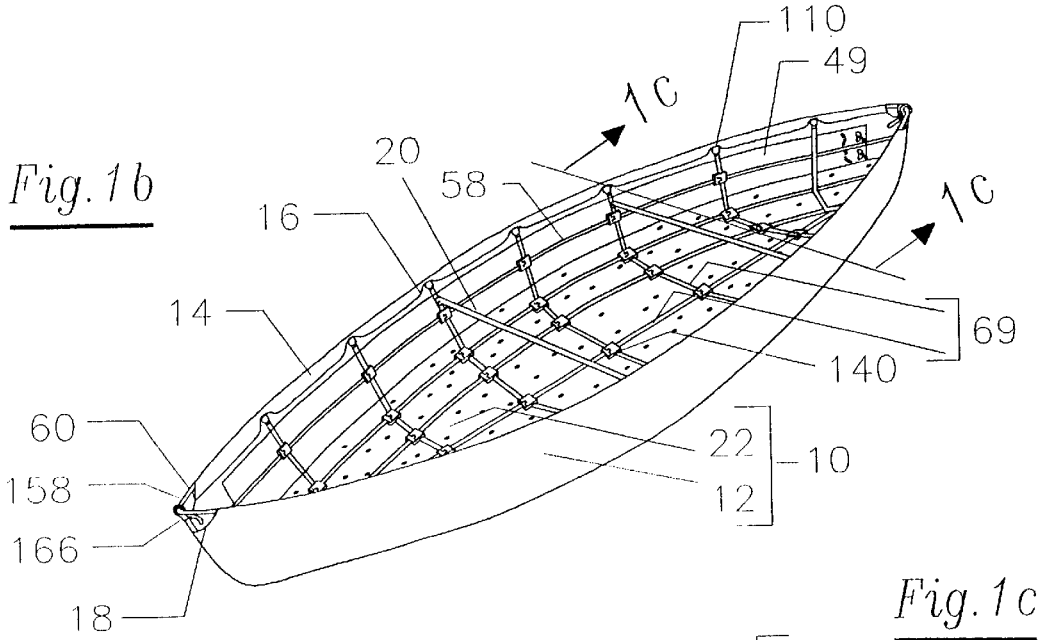
FIG. 1*b* is a perspective top/side view of the folding canoe of FIG. 1*a* with further identification of selected important features.
Figure 1C:
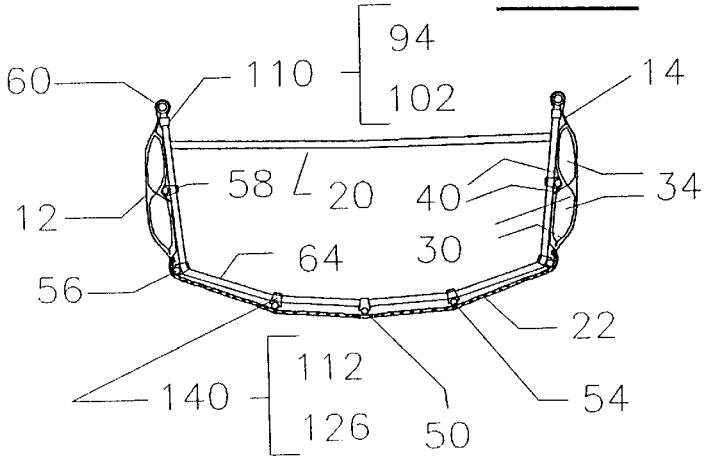
FIG. 1*c* is a sectional view showing the hull skin, the antiflex air bladders, the antiflex cover, a former, a thwart, gunwales, stringers, isoconnectors, lockconnectors, and a shockfloor structure taken at line 1*c*—1*c* of FIG. 1*b*
Figure 1D:
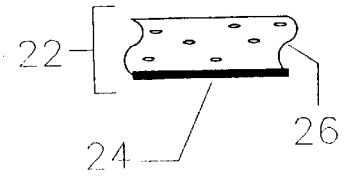
FIG. 1*d* is and enlarged sectional view of a hull-skin-abrasion-reducing, shock-absorbing foam/fabric laminate floor.

A basic embodiment of the present invention built according to the structure and methodology, described herein, is a canoe as shown in perspective views in FIGS. 1*a,* and 1*b.* It comprises a system of three major sub-systems: a flexible hull 10 with a shock-resistant abrasion-reducing foam and fabric laminate shockfloor 22; an antiflex system 49, a hull flex-reduction air-bladder and cover system; and an isoskeleton 69, a structurally-isotropically secure tubular skeletal frame with various connectors, fasteners, and terminators. FIGS. 1*c* and 1*d,* 2*a* and 2*b,* and 3*a* and 3*b,* show details of the three subsystems shown in FIGS. 1*a* and 1*b,* that is, the hull, the antiflex system, and the isoskeleton, respectively.

1. Hull Skin and Shockfloor.

The hull 10 seen in FIGS. 1*a,* and 1*b* completely envelopes the isoskeleton 69, and antiflex system 49, and is held in tension by a combination of both the isoskeleton and the inflated antiflex system.

As seen in FIGS. 1*c,* and 1*d,* the skin consists of a side skin 12 and a shockfloor 22. The side skin preferably consists of a waterproof-coated fabric such as nylon or polyester. In the transverse-to-the-keel sectional view of FIG. 1*c.* taken at 1*c*—1*c* of FIG. 1*b,* the skin can be seen to envelop the isoskeleton 69. FIG. 1*b* shows, at gunwale level, gunwale sleeves 14 through which are threaded the gunwales 60. The sleeves have openings 16 in them, which line up with the ends of the formers 62, 64, 66, 68, shown in FIGS. 3*a* and 3*b,* and provide access to the gunwales for lockconnector 110 access. It can be seen in FIG. 1*c,* below the gunwale sleeves 14, downward along the sides, that an antiflex cover 40, is attached to the inner side of the side skin, creating an envelope for an antiflex air bladder 30.

Farther down, just above the level of chine stringers 56, a shock floor 22 is sewn, heat-welded, glued or otherwise attached, depending on the particular combination of foams and skin fabrics present, to the side skin. FIG. 1*d* shows a shock floor comprising a high density closed cell foam layer such as EVA, ethafoam, or polyethylene, among others, laminated to a floor fabric 24 of the hull. The skin can be either the same or a different fabric from rest of the hull. Ideally, it is constructed of materials more resistant to abrasion and puncture than the side skin, since it gets more abuse when in operation by scraping over such riverine substrates as rocks and gravel. A representative, non-exclusive list, of basic hull fabrics are nylon, rayon, dacron, polyester, hypalon, and might include special formulations of aramid (popularly known as kevlar).

2. Antiflex System.

Figure 2A:
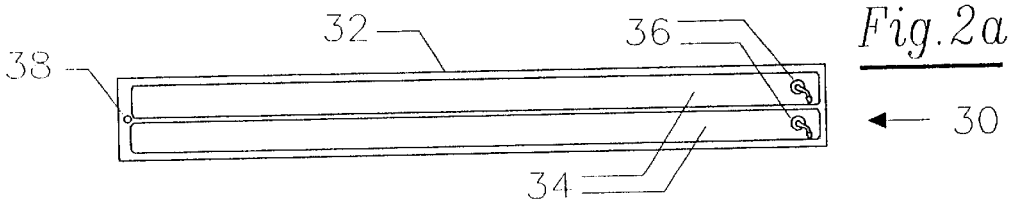
FIG. 2*a* is a face view of a hull-flex reducing, structural-stiffening flotation-providing, air-bladder.
Figure 2B:
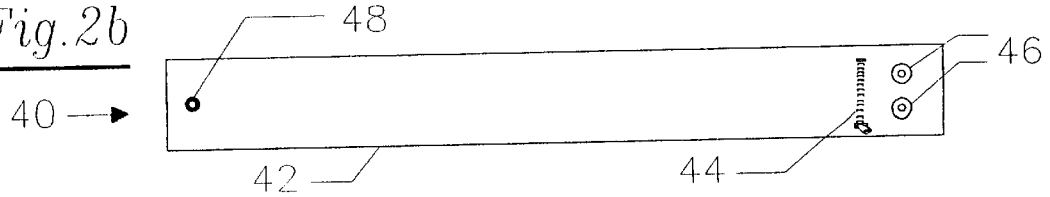
FIG. 2*b* is a face view an abrasion-protective, debris-repelling, hull-stiffening, air-bladder cover with a watertight zipper, threading gasket, and watertight gaskets attached.

Looking at FIGS. 1*a,* 1*b,* and 1*c,* the antiflex system 49 consists of a multiple-chambered air bladder 30 used in conjunction with an antiflex cover 40. As viewed in FIGS. 1*a,* and 1*b,* the antiflex cover is sewn, glued or heat welded to the side skin 12, thereby, creating an envelope with the side-skin, to house the inserted bladder. Looking at FIG. 2*a,* the antiflex air bladder 30 comprises a waterproof-coated-lightweight fabric 32 such as urethane coated nylon, commonly used in whitewater canoes for flotation and widely available, with two air valves 36, and a grommet 38, attached thereto. Looking at FIG. 2*b,* the antiflex cover 40 comprises a waterproof-coated fabric 42, with a watertight-bladder-insertion sliding fastener or zipper 44, a watertight-bladder-threading gasket 48, and a pair of watertight air-valve access gaskets 46, attached thereto. The air bladder itself could be made of natural or synthetic rubber or a pliable plastic or any other material or combinations of materials either laminated or not, which may be found suitable to retain air pressure. The air valve gaskets are of a type of elastic material commonly available and are used, for example, on dry-suit cuffs. Any other suitable gasket material or design as may be suited to the application may be used. The threading gasket can be equipped with a removable screw cap such as the arrangement used to fill waterbed mattresses with water as one of several ways to maintain an access orifice while assuring its watertightness. The antiflex cover retains the inflated air-bladder firmly and continuously along the full length of the side skin providing the greatest amount of structural resistance from flexion. Such flexion, as illustrated in FIG. 9.2*a,* occurs about an axis, in a typical situation of boat stress, centered through the former 62 lying parallel to section line 1*c*—1*c* of FIG. 1*b.,* by the stem 52 ends of the canoe. In other words, the canoe gives the appearance of wanting to fold front-to-back, i.e., bow-to-stern, when running head on into large steep waves with deep troughs separating the waves.

3. Isoskeleton.

a. General.

Figure 3A:
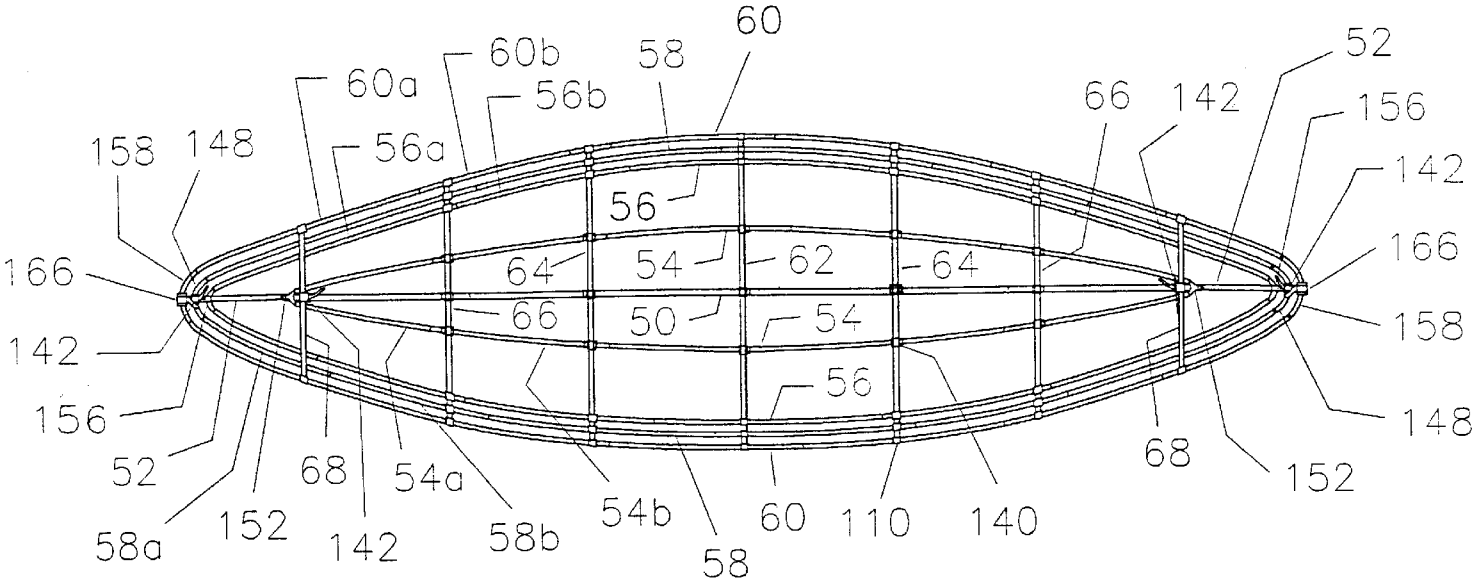
FIG. 3*a* is a top view of an isotropically-secure skeleton or isoskeleton.

Looking at the canoe shown in FIGS. 3*a,* and 3*b,* it can be seen that an isoskeleton 69 comprises a plurality of hollow tubular members called stringers 50, 52, 54, 56, 58, and 60 running the length of the canoe, and a plurality of hollow tubular members called formers 62, 64, 66, and 68, arranged transverse to a keel stringer 50, and each lying in a vertical plane. The stringers in turn are composed of a plurality of shorter sections which are held together by a shock cord system prior to assembly of the isoskeleton. The stringers are distinguishable from each other only by length, position occupied, function, and how connected. Formers differ only in size and position occupied. Formers 64 have thwarts 20. The isoskeleton is held secure as a unit with a variety of terminators, connectors and fasteners as described herein. The isoskeleton can be assembled without the hull. It is free-standing, isotropically secure and can be moved about as a unit. However, in normal assembly during use conditions, it incorporates the hull 10. In FIGS. 3*a.* and 3*b,* the isoskeleton shown contains a central keel stringer 50 connected to the bow and stern uprights, or stems, 52, which combination lies in a vertical plane. The keel stringer defines the horizontal line of symmetry of the isoskeleton. The length of the isoskeleton is the greatest horizontal distance between any two points along the keel and stems assembly. The vertical distance from the line of the keel stringer, best seen in FIG. 3*b,* to any point along the gunwales 60 or gunwale terminators 158 is the depth of the skeleton at the point of interest. The depth of the canoe is measured in a fashion similar to the isoskeleton, except that the additional thickness of the hull must be added to the depth of the isoskeleton. An isoskeleton comprises a central keel stringer with attached stems 52, the combination of which are horizontally flanked by the following: a pair of floor stringers 54, connected at each of their ends to the horizontal portion the stem by a wing fastener 152; a pair of chine stringers 56 connected at each of their ends to a stem near its bend by a modified wing fastener 156; by a pair of side stringers 58, at approximately mid-point in elevation up the side, connected at each of their ends by a strap mount 142 to the stem; by a pair of gunwales, at full elevation, connected at each of their ends to a gunwale terminator which is, in turn, is connected to the stem by a gunwale terminator fastener 166. The isoskeleton is completed by a set of formers 62, 64, 66, and 68 arranged, each, in a vertical plane and normal to the keel stringer. Lockconnectors 110, couple each of the formers to each of the gunwales. Isoconnectors 140 couple each of the formers to each of the stringers 50, 54, 56, and 58. Formers 68 are attached to the keel stringer by a strap fastener 142, but are not attached to the floor stringers with isoconnectors. They remain unattached. A strap mount 142 connects the formers 68 to the keel stringer.

b. Details.

Figure 4A:
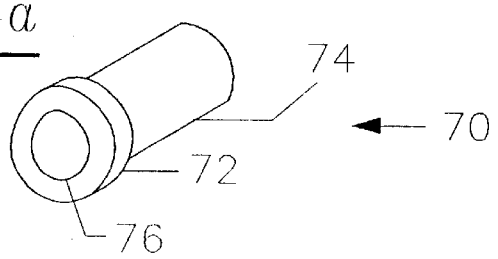
FIG. 4*a* is an end spacer for receiving a wing of a wing fastener, for positionally securing, the end of a shock cord, and for preventing stringer to wing-fastener abrasion.

In the descriptions, hereinbelow, which cover the details of the isoskeleton and how its elements are connected, FIGS. 1*c,* 4*c* and 4*d* are enlarged sectional views, FIGS. 4*a,* 4*b,* 5*a,* 5*b,* 6*a,* 6*b,* 7*a,* 7*d,* 8*a,* 8*c,* 9*a,* 9*b,* and 9*c* are enlarged perspective views, and FIGS. 5*c,* 6*c,* 7*b,* 7*c,* 7*e,* 7*f,* 8*b,* 8*d,* 9*d,* and 9.1 are enlarged fragmentary perspective views.

i. formers

FIG. 1*c* shows a frontal view of a former 64 equipped with a thwart 20. Formers 62, 66, and 68 are not equipped with thwarts in the basic embodiment. Looking at the former in FIG. 1*c,* the female lockconnectors 102, at the gunwale 60 elevation, are permanently fitted into the open ends of the former, and the male isoconnectors 112, at the desired stringer 50, 54, 56, and 58 positions along the former, are permanently attached with rivets to the former. In the basic embodiment presently being described the former 62 forms a vertical plane transverse to the keel, which serves as a reference longitudinal plane of symmetry of the isoskeleton.

ii. floor stringers and chine stringers

Figure 4C:
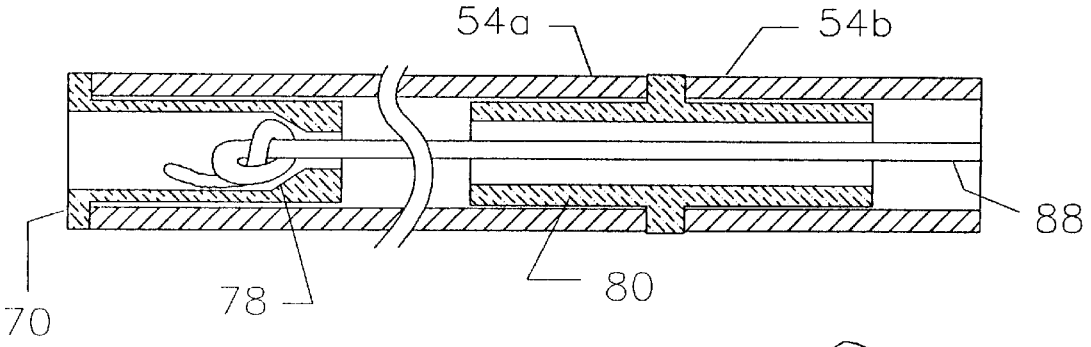
FIG. 4*c* is an fragmentary sectional view of an assembled stringer with a shock cord, the end spacer of FIG. 4*a* and the in-line spacer of FIG. 4*c*.
Figure 4B:
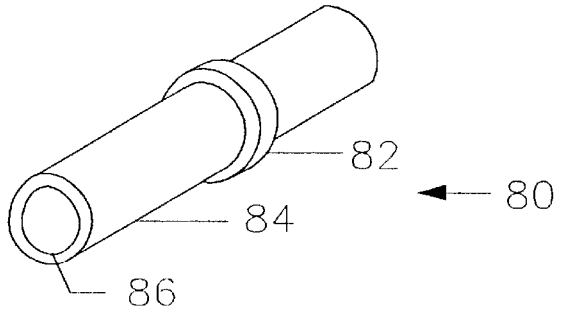
FIG. 4*b* is an in-line spacer to facilitate and speed the assembly of the separate sections of gunwales and stringers and to prevent section-to-section abrasion.

Looking at the sectional view in FIG. 4*c,* each stringer consists of a plurality of shorter sections with adjacent sections connected together by an in-line spacer 80, and with the totality of the assembled sections terminated by an end-spacer 70 at each end. A partial view of an assembled stringer is shown consisting of two sections, 54*a* and 54*b,* in the case of floor stringers, and 56*a* and 56*b,* in the case of chine stringers, which are representative of all stringer-section adjacent pairs, with regard to the inline spacer. An end spacer 70 shown in FIG. 4*a* consists of a cylindrical barrel 74 with a bore sleeve 76 centered in, and running through the length of the end spacer. The end of the sleeve, at the end of the barrel, remote from a lip 72 on the spacer, is of smaller bore diameter than the rest of the sleeve, and is wide enough to accommodate the thickness of the shock cord and to retain a shock cord tied with a knot. Looking at the left side of FIG. 4*c,* the wider part of the bore in the end-spacer is wide and deep enough to accommodate a wing 154 of a wing fastener 152, or 156. Moving to FIG. 4*b,* an in-line spacer 80 consists of a barrel 84 on either side of a lip 82, with a bore sleeve 86 of uniform diameter centered in and running the length of the spacer. The sleeve is wide enough to accommodate a shock cord. The shock cord shown in FIG. 4*c,* may be of braided nylon-bound elastomer commonly referred to as "bungie cord" or any similar device. It is about half the diameter of the sleeve in the in-line spacer and able to just fit through the smallest bore in the end spacer where it would be held in position by a knot tied in it.

iii. gunwales

A special case of a stringer, a gunwale 60 is housed in a gunwale sleeve 14 of a side skin 12 of a hull 10 in a completely assembled canoe. Looking at FIG. 4*d,* the gunwales consist of a plurality of sections, represented by 60*a,* and 60*b,* and connected by in-line spacers the totality of which is held together by a shock cord 88 prior to assembly of the isoskeleton 69. The terminal sections of the gunwales have embedded in them a stud tube 90 which acts as a securing device for the ends of the shock cord. At the gunwales, the formers are terminated and are connected to the gunwales with lockconnectors 110. The male lockconnectors 95 may be permanently attached to the gunwales, at the positions corresponding to locations of the formers along the keel stringer, in the assembled isoskeleton.

iv. keel stringers

Figure 3B:
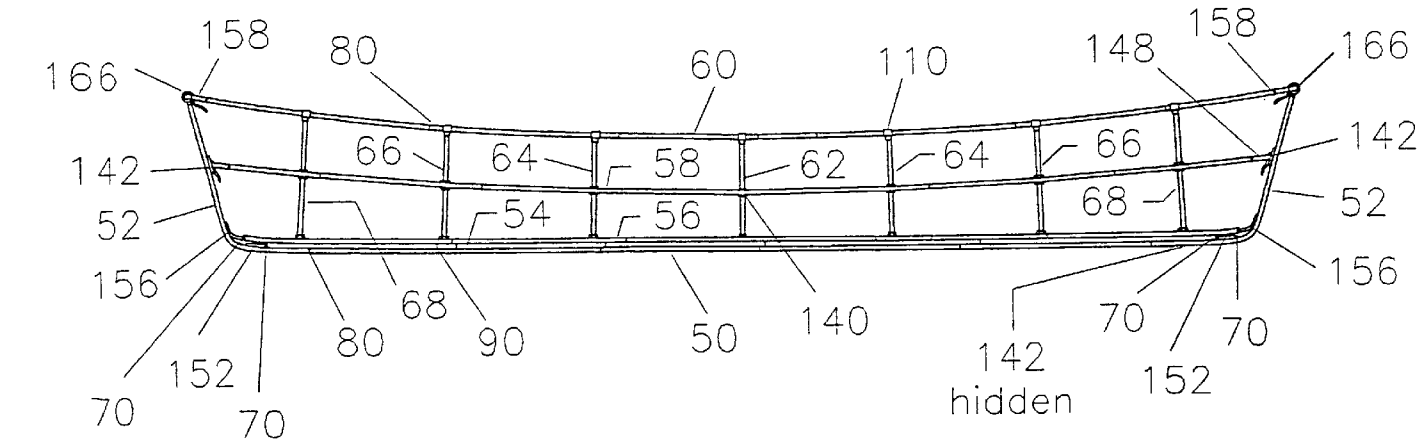
FIG. 3*b* is a side view of the isoskeleton of FIG. 3*a*.
Figure 4D:
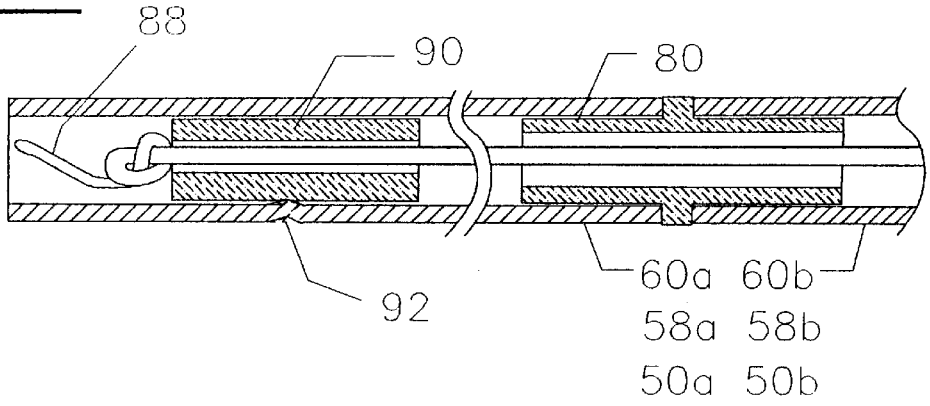
FIG. 4*d* is an enlarged fragmentary sectional view of an assembled keel gunwale, or side stringer.

A keel stringer 50 is shown in FIGS. 3*a* and 3*b* comprising an assemblage of shorter sections of which 50*a* and 50*b* are representative, and connected by in-line spacers, and terminating with locking stub tubes 90, which, in turn, terminate a shock cord 88 running the length of the keel. FIG. 4*d* illustrates how the sections are strung together. The keel forms the long axis of the canoe.

The keel stringer is connected at its each end to a stem in the assembled isoskeleton which combination forms the vertical reference plane for lateral symmetry of the isoskeleton.

v. side stringers

A side stringer 58 is strung together of shorter sections using in-line spacers, locking stub tubes and shock cords in the same way as gunwales 60 and the keel 10 are as per FIG. 4*d.* vi. lockconnectors—connecting formers to gunwales.

Figure 5A:
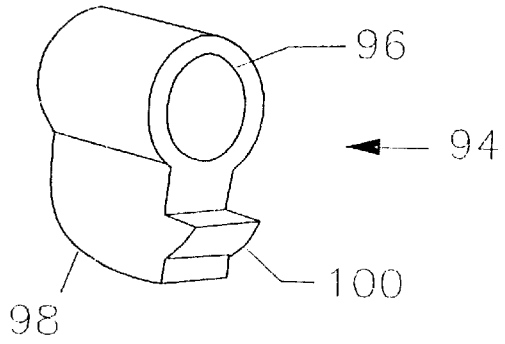
FIG. 5*a* is a perspective view of a former-to-gunwale locking connector or lockconnector, male part.
Figure 5B:
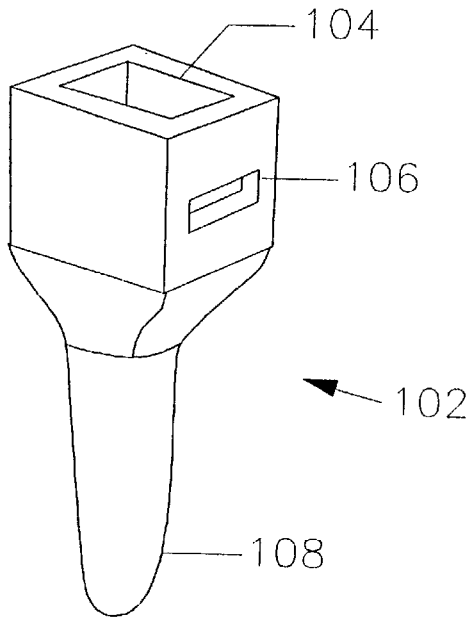
FIG. 5*b* is a perspective view of former-to-gunwale lockconnector, female part.
Figure 5C:
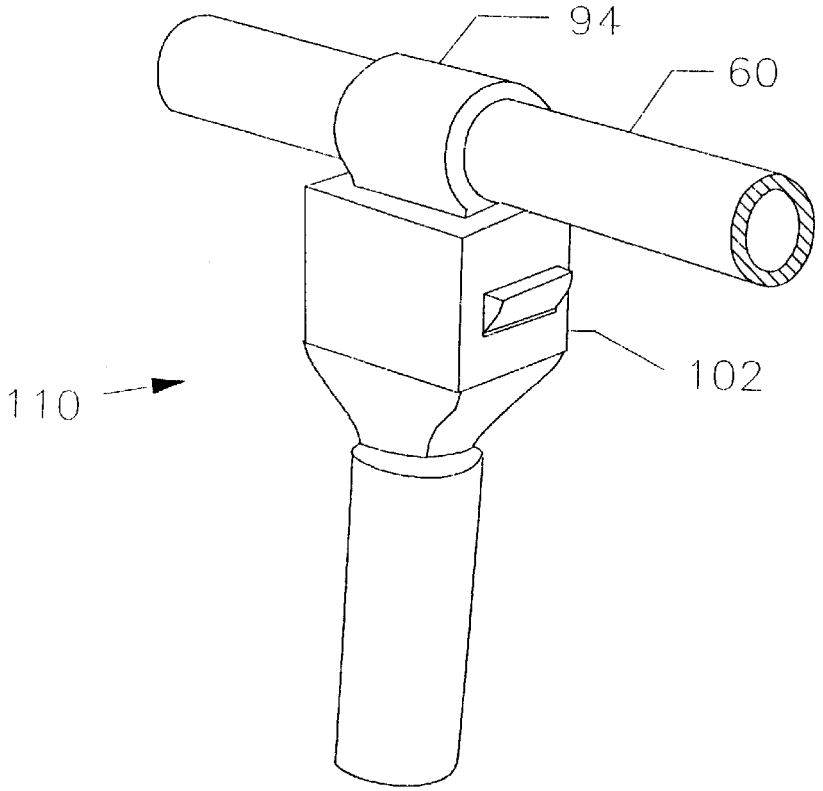
FIG. 5*c* is an fragmentary view of a former locked to a gunwale using the lockconnectors of FIGS. 5*a* and 5*b*.

As seen in FIG. 3*a,* gunwales 60 are connected to formers, at the locations of formers 62, 64, 66, and 68 along the gunwales, using a lockconnector 110 of FIG. 5*c.* The male lockconnector 94, as shown in FIG. 5*a,* comprises a gunwale sleeve 96, a locking base 98, and a locking ledge 100. The female lockconnector of FIG. 5*b* consists of a base 108 for insertion and securing into the open end of a former, and a male channel 104, and a lock slot opening 106. When assembled, the male lockconnector base 98 is fitted into the base channel 104 of the female lockconnector 102, and is locked in position by engagement of the male locking ledge into the lock slot of the female. Once engaged, the connector is locked in every direction except the return path by which the pair were assembled. The isoconnectors connecting the formers with the stringers, being an isotropically secure connection, will maintain the lockconnector in a locked attitude. The two types of connectors cooperate.

vii. isoconnectors—connecting formers to stringers.

Figure 6A:
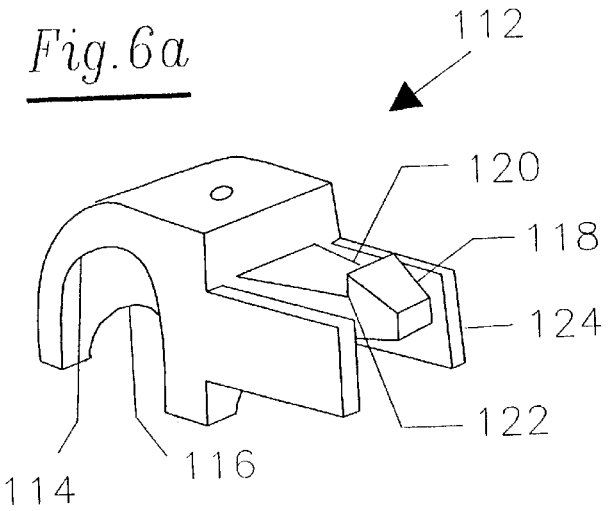
FIG. 6*a* is a perspective view of a former-to-stringer isotropically-secure connector or isoconnector; male part.
Figure 6B:
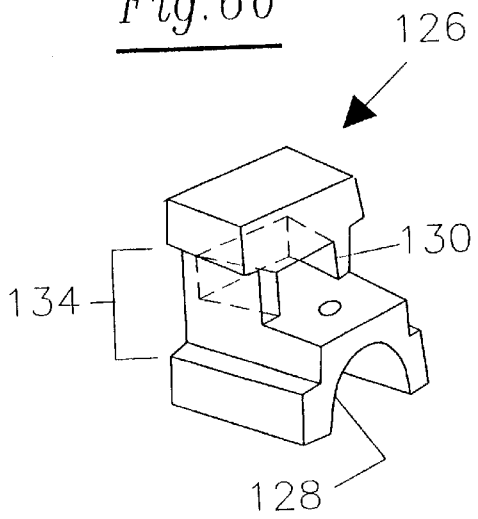
FIG. 6*b* is a perspective view of an isoconnector; female part.
Figure 6C:
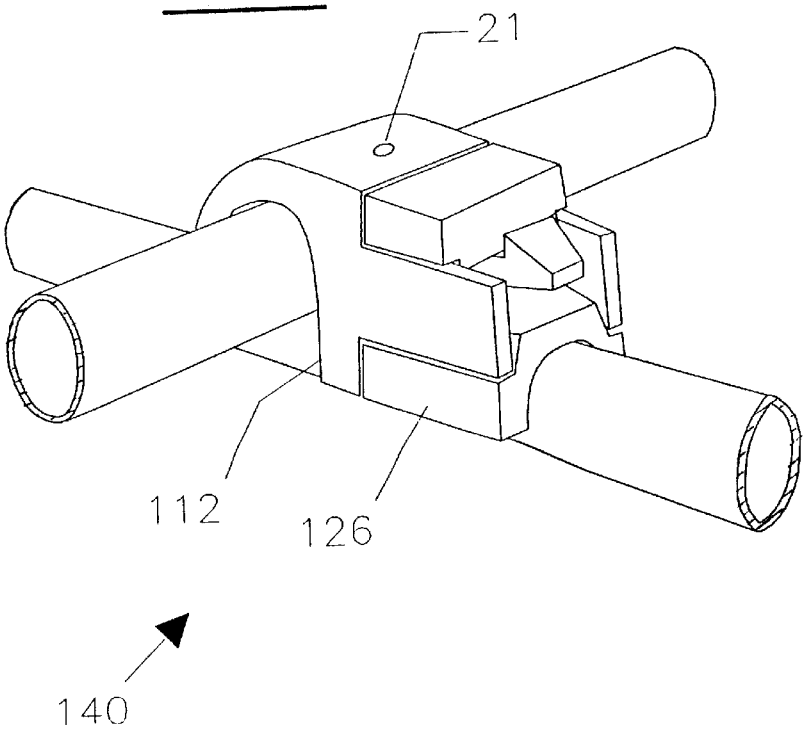
FIG. 6*c* is a former connected to a stringer using the isoconnectors of FIG. 6*a* and FIG. 6*b* for an isotropically secure coupling.

As is shown in FIGS. 3*a,* and 3*b,* each of the stringers 50, 52, 54, 56, 58 are connected to each of the formers 62, 64, and 66 by an isoconnector 140. Only stringers 56 and 58 are connected to formers 68 using an isoconnector. Looking at FIG. 1*c,* male isoconnectors 112 on each former are fastened along the former at positions which correspond the desired positions of each stringer in a lateral direction from the keel stringer 50. Looking at FIG. 6*a,* a male isoconnector is constructed with a former channel 114 to receive a former. Each male isoconnector is fastened to a former by a rivet 21 or some other suitable device such as a screw. Looking at FIG. 6*b,* a female isoconnector is constructed with a stringer channel 128 to receive a stringer. Each female isoconnector is fastened to a stringer by similarly to the fastening of the female isoconnector to a former. The male and female parts are assembled by lining up the stringer channels along the same axis, and sliding the thumb locking tab of the male member into the tab receiver slot 130 of the female member until the locking lip 12 of the thumb tab engages. When the pair are locked together the connection is secure in all directions except along the return path by which it was assembled, but only when the thumb tab is pressed and the locking lip is disengaged. The male projection of the male isoconnector, the thumb locking tab 118, is flanked by two auxiliary locking tabs 124 equally spaced and on opposite sides of the thumb tab. Taken together, the thumb tab, and the auxiliary tabs form an orthogonal system of planes with the front and rear faces of the male isoconnector The auxiliary locking pair adds additional security by engaging the auxiliary slots 134 on the female isoconnector. The auxiliary slots may be open as in the figure or completely enclosed as a sleeve for added strength of the part when under stress. The auxiliary locks give isometric security except along the mono-directional return path by which they were engaged, and then only when deliberately unlocked. The auxiliary tabs on the male isoconnector additionally prevent the locking thumb tab from being accidentally released by shielding it, laterally, and by shielding it from above, from objects of dimensions wider that the distance between the tabs, which is about the width of an adult human thumb. Alternate embodiments of the basic canoe, with the same number of formers and stringers may have fewer isoconnectors than the one presently being described depending on how many are actually required for the skeleton to be secure.

viii. strap fastener—connecting a former to a stringer

Figure 7A:
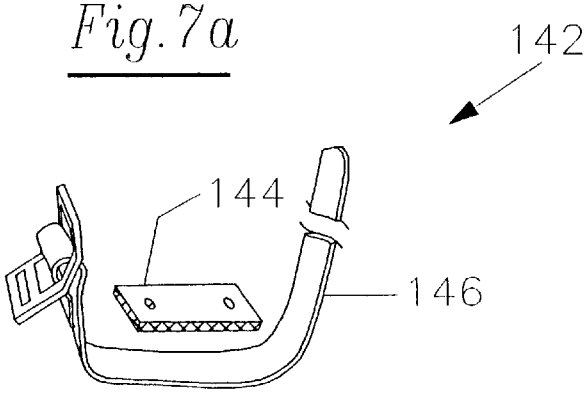
FIG. 7*a* is a perspective side view of a strap fastener.
Figure 7B:
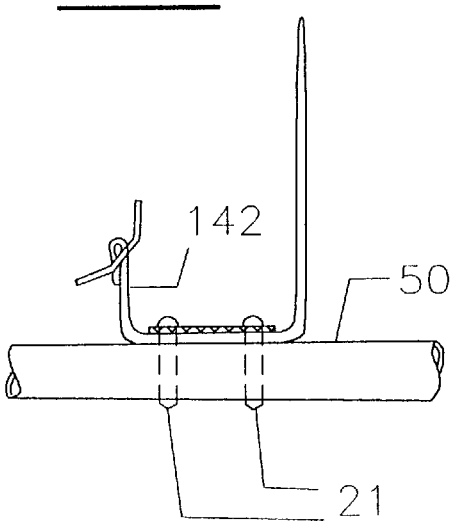
FIG 7*b* is a fragmentary side view of a strap fastener attached to a keel stringer.
Figure 7C:
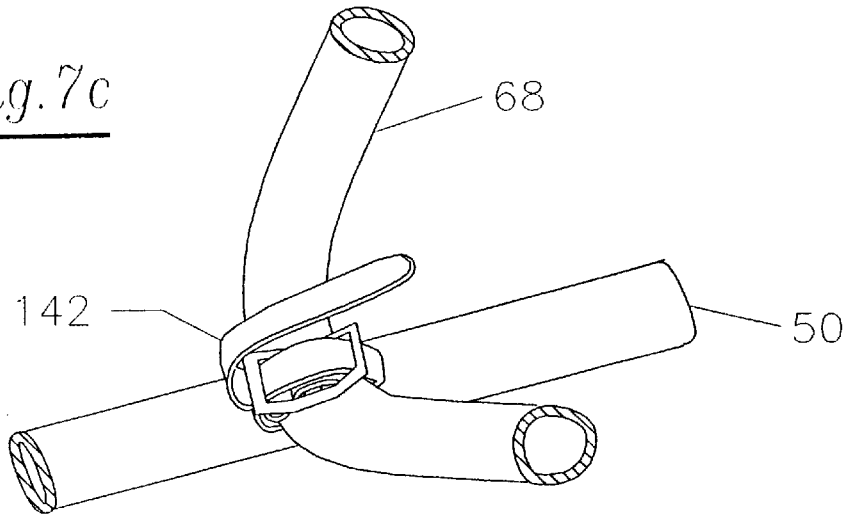
FIG. 7*c* is a perspective view of a former mounted to a keel stringer using the strap fastener of FIG. 7*a*.

Looking at FIG. 7*c,* the strap fastener 142 secures a former 68 to a keel stringer 50. A strap fastener comprising a strap with attached buckle 146, and a metal plate with rivet holes 144 attached to a keel stringer are shown in FIG. 7*b.* The view shown in FIG. 7*c* shows the securing strap of the fastener wrapped around the former and secured with the buckle to complete the connection.

ix. strap fastener—connecting side stringers to a stem

Figure 7D:
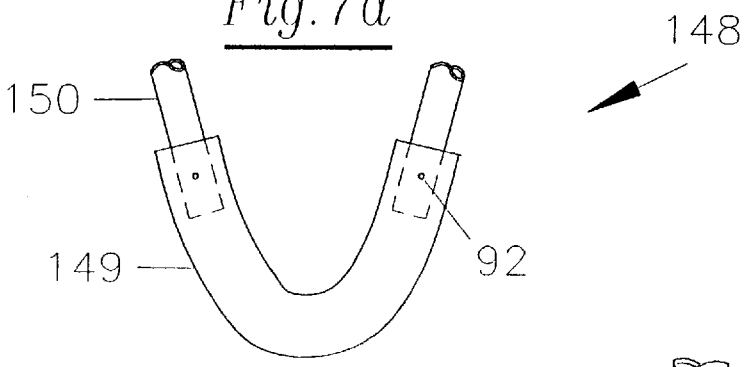
FIG. 7*d* is a fragmentary side view of a side-stringer terminator.
Figure 7E:
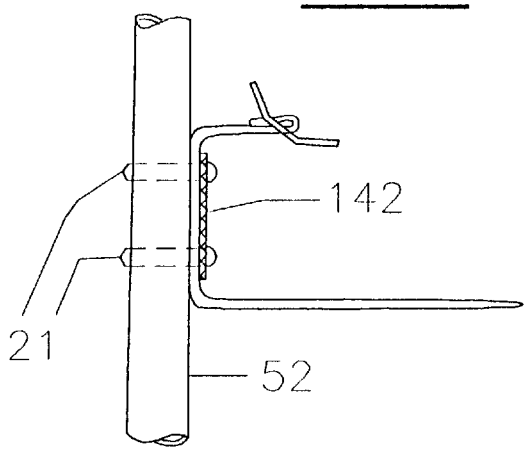
FIG. 7*e* is a fragmentary perspective view of a strap fastener attached to a stem.
Figure 7F:
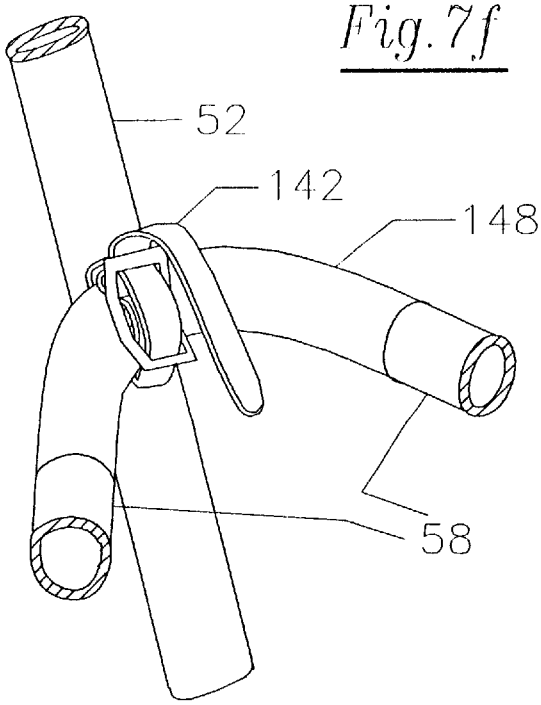
FIG. 7*f* is a fragmentary perspective view of a side stringer connected to a stem using the strap fastener of FIG. 7*a* and the side-stringer terminator of FIG. 7*d*.

A side stringer 58 is connected to a stem 52 by a strap fastener 142 as shown in FIGS. 7*e* and 7*f.*

In FIG. 7*d,* is shown a side-stringer terminator 148 comprising a section of bent tube 149 with a smaller diameter stud tube connector 150 inserted into each end. Each stud tube is secured in position by a center punch indent. The terminator stub tubes are inserted into the ends of a side stringer and the combination is connected to the stem and secured by the strap fastener. Alternately the side stringer could be constructed like a floor stringer, or a chine stringer, and secured to the stem using a modified wing fastener similarly to the connection of a floor stringer to a stem shown in FIG. 8*d* or by a strap fastener 176 as shown in FIG. 9.3*b*.

x. wing fastener—connecting floor stringers to a stem

Figure 8A:
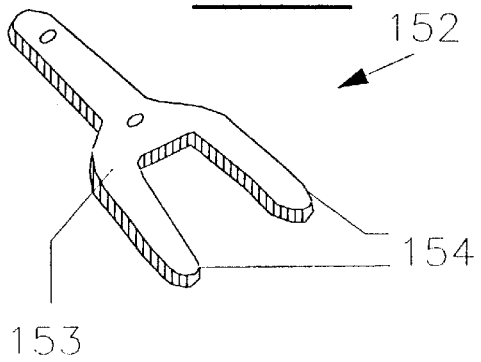
FIG. 8*a* is a perspective view of a wing fastener.
Figure 8B:
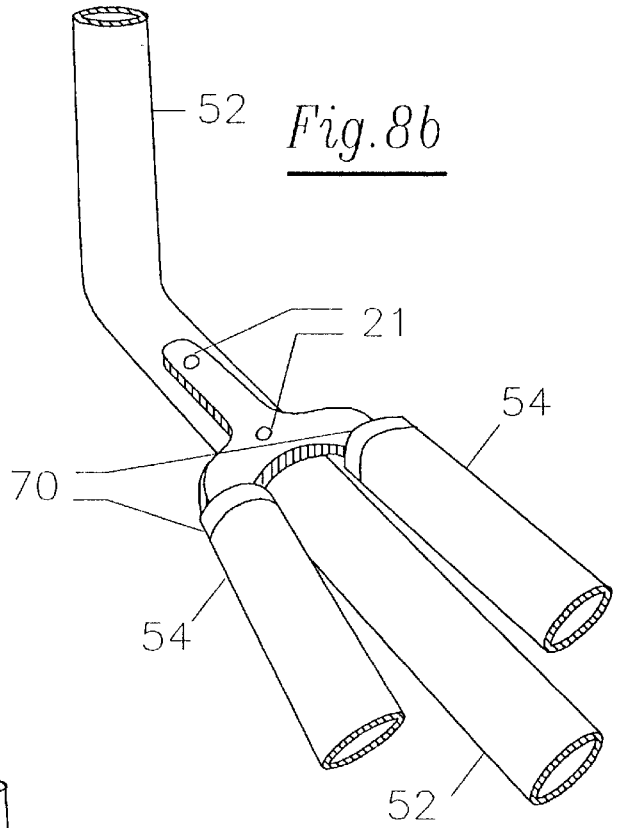
FIG. 8*b* is an fragmentary view of a stem connected to floor stringers using the wing fastener of FIG. 8*a*.

FIG. 8*b* is a view of floor stringers 54 connected to a stem 52 using the wing fastener 152 of FIG. 8*a*. The wing fastener comprises a body 153, and two separate wings 154. The wings are inserted into and secure the ends of stringers to the stem. In alternate embodiments wing fasteners may be placed anywhere from the horizontal floor portion of a stem to its top at gunwale level.

In an assembled isoskeleton, the stringers are retained and held in compression by the wing fasteners and held in position along the formers by the isoconnectors 110, as described hereinabove.

xi. modified wing fastener—connecting chine stringers to a stem

Figure 8C:
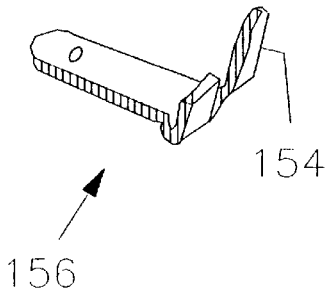
FIG. 8*c* is an fragmentary view of a wing fastener modified for attachment of chine stringers.
Figure 8D:
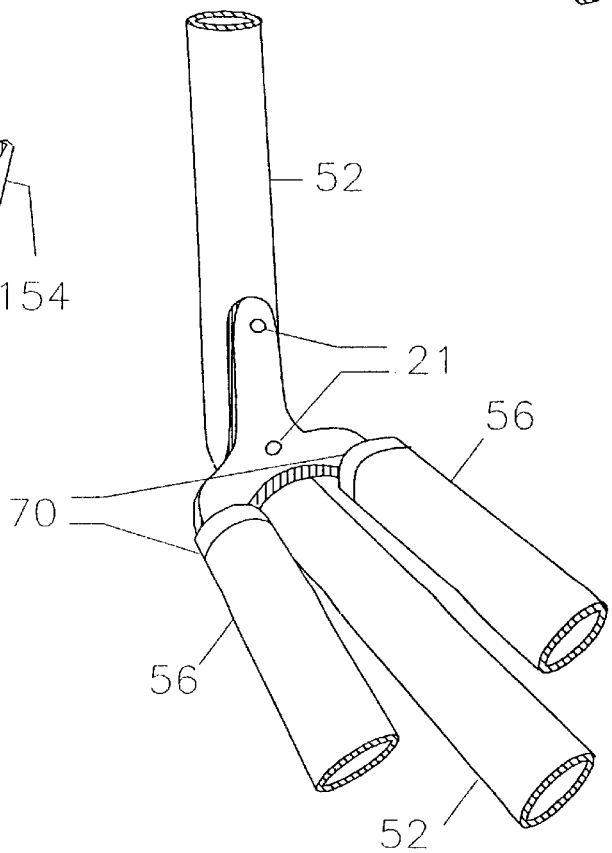
FIG. 8*d* is an fragmentary view of a stem connected to chine stringers using the modified wing fastener of FIG. 8*c*.

Similarly to the connection of floor stringers 54 to a stem 52, as shown in FIG. 8*b*, the chine stringers 56 shown in FIG. 8*d*, are connected to a stem by the wing fastener 152 shown in FIG. 8*a* which is modified to fit on the vertical portion of the stem and is subsequently shown in FIG. 8*c* as modified wing fastener 156. FIG. 8*d* is a view in which the ends of the chine stringers are installed over the wings 154 of the modified wing fastener thus completing the connection.

xii. gunwale terminator—connecting gunwales to a stem

FIG. 9*d* shows a pair of gunwales 60, with a gunwale terminator attached, connected to a stem 52 by a gunwale fastener 166. FIG. 9*c* shows a gunwale terminator fastener comprising a terminator mount 162 with a securing strap 146 as shown in FIG. 9*c*. The gunwale terminator mount, shown in FIG. 9*b*, comprises a gunwale terminator mount 160, jaws 161, base 162 and contains a strap slot 164. The securing strap 146 is slotted through the strap slot of to complete the fastener. The base of the fastener is inserted into the open end of the stem near gunwale level. The view in FIG. 9*a*, shows a gunwale terminator which is constructed identically to a side-stringer terminator 148, differing only in the degree of bend in the terminator tube. The gunwale terminator, which is attached to the gunwales by the insertion of the terminator stud tube into the open ends of the gunwale, reposes in the jaws of the gunwale terminator mount 160 after connection. The securing strap is wrapped around the gunwale terminator, over the top of the jaws and buckled at the rear of the jaws thus securing the completed the connection.

xiii. universal grasp connector

FIG. 9.1 is an enlarged perspective view of a universal grasp connector 170. The purpose of the grasp connector to join together separate members such as stringers and formers at angles from zero degrees to ninety degrees within the fan of repose 173 as shown in the figure. With teeth 171 in the jaws that are wider than those show in the diagram as sketched at the bottom left the figure, it is possible to connect members in almost any spatial angle to each other limited only by the attitudes at which the members actually intersect each other's trajectory. Although the diagram illustrates a connector for tubes of the same diameter, by altering the diameter of the mounting bore sleeves, and/or the jaws, many combinations of different tubes sizes can be connected together. The connector consists of only one element, a single jaw 168. The complete connector comprises two such identical jaws and a strap with a buckle or Velcro or some other retaining strap or cord or similar securing device. This securing strap or cord or other device serves to close the bore sleeve around the member referred to as the mounting member and jaws around the target member being connected to, and to fasten them securely together. This connector has not been used in the basic embodiment described herein in the form of a canoe. However, illustrative applications are shown in FIGS. 9.3*a*, & 9.3*b*, and, 9.4*a*, & 9.4*b* as part of the isoskeleton of a dinghy and a drift boat respectively. Mounting a stop block 172 to the mounting member beside a grasp connector comprises a locking grasp connector by preventing further travel of the free end of the target member, i.e., it will lock the free end of a target member in place.

xiv. isoskeleton antiflex stringers

FIGS. 9.5*a* and 9.5*b* show top and side views, respectively, of a drift boat, or a dory. Both boat types are nearly indistinguishable from each other in some of their designs. Shown is a hull antiflex stringer system 178, which purpose is to reduce flex in the hull in the boat in the forward to aft directions, as is illustrated in FIG. 9.2*a*. The antiflex stringer system, as implemented in this particular design for a dory, comprises two pairs of antiflex stringers, fastened at the fore and aft ends of the boat and cross each other toward either end of the boat being fastened to each other at four points. In the embodiment shown in FIGS. 9.5*a* and 9.5*b*, they are fastened to formers, the gunwales, and to chine stringers.

1. Operation of the Elements of the Invention a. Antiflex system.

In FIG. 9.2*a*, a canoe is illustrated with flex occurring in the hull when operated in waves in a rapid. Canoes react to waves in a lake in a similar fashion. This flex can be an undesirable behavior of hulls in many folding boat designs. Air bladders can reduce it. If a single round and long chamber is used as the air bladder in the antiflex system, air pressure alone must be relied on to provide stiffness, which may or may not suffice, depending on what is built into the frame or skeleton of the craft to reduce flex.

However, air-bladders can provide additional mechanisms for reducing flex. A mechanism whereby air bladders can increase the rigidity of the hull structure of a canoe can be understood by considering an air mattress as illustrated in FIG. 9.2*b*. Such air mattresses are used for sleeping on the ground on camping trips, and as flotation devices in backyard pools. It should be familiar to most people, that the mattress can easily be folded about an axis along its width as shown as the z axis, with somewhat more difficulty along its length as shown as the x-axis, and difficult or impossible along the y-axis aligned with the thickness of the mattress. As the air pressure is increased in the mattress, it becomes more rigid making bending about both the z and x axes even more difficult. Thus it can be seen that, by controlling both the shape of the mattress and the amount of pressure in it, and by considering its orientation, resistance to bending can be controlled. All three of these principles are implemented in the antiflex air-bladder system.

If the design of the shape of the air-bladders in the sides of a folding boat mimic the shape of the air mattress discussed above, and if their placement and orientation in the folding watercraft is such that the natural bending resistance about its y-axis works against the natural bending or flex of a folding boat hull as illustrated in the canoe in the rapids, then a method is arrived at to control hull flex. The solution in folding boats is to place air-bladders in the sides of the boat between the hull skin and the skeletal framework of the boat while maintaining as close to the ideal mattress shape and the proper orientation required to control flex of the air bladders.

The preferred solution for resisting bending in a folding boat's hull is an airmattress-shaped air bladder oriented with its length along the length of the boat and with its width oriented vertically. This is closely approximated in the canoe of FIGS. 1*a,* and 1*b.* The closer to this shape and orientation the better. Firmly affixing the air-mattress to the side skin of the canoe, so that it for all practical purposes it could be considered a part of the skin, accomplishes the preferred orientation. When the shape of the canoe changes because of the waves, the canoe hull will attempt to bend the air mattress. The air mattress will resist.

Other considerations help determine the shapes of the air-bladders implemented in various models of various kinds of folding boats. Among those are: the desired exterior shape of the outside of the boat hull for esthetic and performance reasons; the depth of the boat; the overall size of the boat; the desire to have the higher volume air-bladders to maximize the flotation ability of the craft in case of an upset; the desire to increase air-bladder thickness for a narrower interior waterline beam of the canoe compared to the exterior waterline beam; for increased stability when swamped; the position and number of side stringers available in a particular model; the presence of other structural members such as isoskeleton antiflex members; the implementation of the number and trajectories of stingers; and other structural considerations in other types of folding watercraft.

b. Side stringers.

The presence of the side stringers, alone, reduces hull flex in the absence of air bladders. But they also play an important role in retention of air bladders, when present, which ultimately translates to less hull flex. If an air mattress is placed between the skeletal structure of a canoe and its hull side skin, but is neither attached to the side skin of the canoe using an antiflex cover nor pressed tightly against it due to a missing side stringer, the following occurs: As the canoe rises and falls over the crests of waves and into the troughs between them, the shape of the canoe will change, and its hull will flex to bend with the waves. Since the mattress is not firmly attached, it will tend to retain its original straight rigid shape. As the canoe hull flexes, the mattress will not be bent with the canoe because, for all the reasons stated above, it wants to remain straight and rigid. Thus the canoe skin and formers will slide up and down past the mattress as the canoe flexes with the waves. Thus the mattress in the above situation is ineffective at reducing hull flex.

Side stringers also have importance in assisting the antiflex system 49 to be more effective. They perform a dual function in reducing flex by helping maintain the air-mattress shape of the antiflex system. They should be attached at their ends to the stem of a canoe, or to some other member in other types of folding craft, to be most effective. In some short models of canoes or kayaks forgoing securing at the ends of the stringers is feasible. As can be seen in FIGS. 1*a* and 1*b,* the side stringers are centered along the antiflex air-bladder system in a such a manner to retain the air bladders continuously along the length of the canoe. This both presses the air bladder into the sides of the hull skin and prevents minor lateral buckling of the air bladders and side of the hull skin.

In the antiflex system the antiflex cover is firmly attached to the hull skin. The air-bladder inside it is inflated to the extent of completely filling the envelope created by the side skin of the canoe and the antiflex cover. This envelope, for all practical purposes, is an integral part of the skin and is shaped more like the air mattress discussed above than like the multi-chambered air bladder contained inside of it. Thus the total antiflex system behaves like the air mattress in providing rigidity to the canoe. This is basically the principle of operation of the antiflex system used in the canoe described in the basic embodiment of the invention.

So the elements of the more effective and preferred antiflex system are 1) shape and size of the antiflex air-bladder, 2) the antiflex cover, 2) the amount of air pressure present in the air bladder, and 3) assistance from side-stringers, and 4) orientation of the air bladder.

c. Lockconnector.

The lockconnector locks when assembled. However, it may disconnect if some external means is not present to prevent it from following the reverse path in which it was assembled. In the assembled canoe, as a basic embodiment of the present invention, the isoconnectors, which are also attached to the formers, provide this external means. They lock the former securely to the stringers thus preventing the lockconnectors at gunwale level from disconnecting. The formers to which the lockconnector female part is connected, prevent the reverse disconnection from taking place. The two types of connectors, via the former, work together.

d. Isoconnector.

Isoconnectors lock securely in all directions in a generally isotropically secure fashion. The locking elements are the locking thumb tab 118, and the auxiliary locking tabs 1243 and their mating parts on the female isoconnector, the tab receiver slot 130 and the auxiliary slots 134. In the embodiment of this connector used in the basic embodiment of a folding boat, a canoe, the channels on the bottom of the isoconnectors provide additional stabilizing action.

e. Wing fastener.

A wing fastener is used to hold fast the open end of a stringer at a fixed location. By bending either the wings or the body of the device, it can be adapted to be used almost anywhere in the skeleton of the boat.

f. Universal grasp connector

In FIG. 9.1, the universal grasp connector 170 consists of two basic parts, a pair of jaws 168 and a securing strap 146 or other similar or useable cord or strap. The bore sleeve of one jaw is placed on a mounting member such as a former, secured with a rivet or a screw or, in some cases, not secured at all, at the desired position on the former. The second jaw is similarly positioned while placing the target member through the receiver bore created by the teeth 171 of the two separate jaws. The securing strap which was pre-inserted through the strap slot on the jaws is now pulled around either the front or the back of the jaws of and fastened, completing the connection. If the target member passes through the receiver bore normal to the teeth, then the jaws will clasp shut to the point of contacting each other. At any other angle the jaws will be open to varying degrees and not in contact with each other. The adjusting strap allows for this while still completing a secure connection. The locus of possible angles for the case shown in FIG. 9.1 comprises a fan of repose of the target member. If the teeth are made wider as shown in the bottom left side of the figure, the fan is enhanced to become a cone of repose and the connector becomes more universal. When a grasp connector is mounted on a mounting member along and beside a stop block 172, the pair comprise a locking connector.

g. Isoskeleton antiflex stringers

Both concave and convex hull flex in a canoe is illustrated in FIG. 9.2*a*. The antiflex stringers shown in the drift boat in FIGS. 9.5*a*, and 9.5*b*. function to reduce the hull flex. The principle of action involved is that when the boat hull is forced to bend in a convex way, the antiflex member connected at its middle to the gunwale prevents it. When the boat hull is forced to bend in a concave way, the other antiflex member prevents it. Thus we have flex prevention without the use of air bladders. This has application in almost any folding boat, but will be more effective in the deeper boats. It can be used in a variety of boats regardless of the shape of the hull at the bow and stem ends of the boat, i.e., squared off vs. rounded or sharpened. It may consist of only a single stringer, rather than a pair, on either side of the craft. If it is implemented in this latter way, in order for adjacent telescoping sections to remain engaged after assembly, they would be secured with cotter pins or other suitable securing pins.

2. Versatility of the Invention by Ease of Assembly

The versatility of the present invention is illustrated, in part, by appreciating the following detailed description of how one can assemble the folding boat of the present invention.

1) Lay the hull skin 10 on the ground unfurled with open side up;
2) Assemble each stringer 50, 52, 54, 56 58 and the gunwales 60 by unfolding the shockcorded sections of the stringers until they are end-to end and joining them by inserting barrel 84 of each in-line spacers protruding from the end of a section into the open end of its adjacent section until all stringers are assembled;
3) Assemble the entire keel assembly by fitting the stud tube 150 of each stem 52 into end of the keel stringer and positioning it within the hull skin in its final position;
4) Lay the floor stringers 54 and chine stringers 56 lengthwise inside skin on either side of the keel stringer assembly in pairs, each of a given pair symmetrically juxtaposed on either side of the keel stringer according to its position in the completed assembly;
5) Insert a gunwale terminator fastener into the open end of the stems;
6) Slide each gunwale pair through the gunwale sleeves 14 sewn into the skin by inserting each into end of a sleeve at the opening 18 until they protrude out the opposite end of the sleeve;
7) Connect the gunwales to the gunwale terminators by sliding the stud tube 150 of the terminator into the open ends of the gunwales.
8) Using the strap 146 of the gunwale terminator fastener, lever the terminator into the jaws 161 of the terminator mount 160 at each stem and secure the buckle on the strap.
9) Slip one end of each of the floor stringers 54 over a wing 154 of a wing fastener 152, then tension each stringer creating an upward curving bow in it in order to fit it over a wing of the wing fastener in the opposite end of the keel. Then pressing the stringers into the floor of the canoe and slightly outward, position them on the floor of the canoe in approximately their final positions.
10) Repeat the same procedure, as number 8 above, with the chine stringers 56 connecting them to the modified wing fastener 156.
11) Assemble both side stringers as a unit by connecting the side-stringer-terminator 148 to the side stringers 58 by inserting the stud tube 150 of the terminator into the open ends of the side stringers at both ends.
12) Slip the side stringer unit down into position, bowing the rods as necessary, until the strap fastener positions are reached; then buckle the strap 146 around the terminator and fasten the buckle.
13) Do the following starting with the center former and working with successive pairs toward the ends of the boat, while facing the end of the boat, and swinging the formers away from yourself, until all are inserted: Start connecting each former by inserting the male channels 104 of the female lockconnectors 102, attached at each end of the former, over the base 98 of the male lockconnectors 94 attached to the gunwales, starting with the former tilted at approximately a 45 degree angle such as to effect engagement of the base with the male channel, then pivoting the former about the gunwale lock connector downward such that the channels of the male isoconnectors engage the pre-positioned stringers and continue by sliding the former into position along the stringers sufficiently far enough to engage the male and female parts of the isoconnectors.
14) Then if bow and stern end caps are provided, snap or inset them into position at bow and stern;

Insert the seats or saddle or whatever other seating arrangement chosen as an option with the boat;

Attach bow and stern painters; Tie in interior float bags if whitewater is going to be attempted;

14) Complete the assembly of the boat by inflating the air bags with the air pump provided; 15) Pick up a paddle, put on a life vest, launch the boat into the water, get in, paddle, and have fun!

From all of the above the reader will see that the invention is a versatile structure and methodology for building lightweight, easy to transport, easy to assemble, folding watercraft. While the description of the basic embodiment of the invention, a canoe, is described in detail, it is only one embodiment among many possible ones. It should not be construed as a limitation on the scope of the invention but as an exemplification of one preferred embodiment thereof. Other exemplary embodiments are illustrated in FIGS. 9.3*a* & 9.3*b*, 9.4*a* & 9.4*b*, 9.5*a* & 9.5*b*, 9.6*a* & 9.6*b*, 9.7*a* & 9.7*b*, and discussed herein.

G. REPRESENTATIVE ALTERNATE EMBODIMENTS

For all of the alternate embodiments only the assembled isoskeleton and its most important features or design elements are annotated. With the exception of the kayak, for which the isoskeleton is first assembled, then inserted into the skin, all the alternate embodiments assemble in a fashion similar to the basic embodiment, the canoe.

1. Dinghy

A dinghy is most often seen being towed behind a sailboat on an inland lake or strapped on deck of an ocean going craft. Its primary use is to get to the sailboat from the shore and back. It typically sees little other use. Thus a lightweight, easily storable, inexpensive dinghy would be desirable to owners of sailing craft. If the dinghy is manageable enough, even owners of relatively small motorized watercraft would find a place for such a boat. These are what the present invention is intended to accomplish. It can be built with or without the antiflex air-bladder system. The dinghy shown in top and side views FIGS. 9.3*a,* and 9.3*b,* respectively differs from the canoe and the remaining alternate embodiments in having a squared-off stem. The connector which makes this possible is a modified mount isoconnector 174 which connects all longitudinal members, including the gunwales, to the stern structural assembly. Although the stern assembly shown in the diagram is incomplete, in that reinforcing members are not shown, (the diagram shows only the stern former capped by a cross-member called a stern gunwale or stern thwart) it is complete in the sense that it demonstrates the application of the design technology to an alternate hull shape. Note that an alternately mounted embodiment of a gunwale connector 176 with securing strap is used to connect the stringers to the bow stem. The application also includes isoconnectors, lockconnectors, wing fasteners and a strap fastener. The strap fastener used to hold down the bow former is a second alternate embodiment of a gunwale terminator fastener and is called a strap fastener although physically structured differently from the strap fastener 146 used in the canoe.

2. Bullboat

The bullboat as replicated in FIG. 9.4*a* was used by the Northern Plains Indians such as the Sioux, Crow and Arapaho for crossing rivers, even at flood time. They were extremely seaworthy because of their hull shape and could be made within a few hours but were usually abandoned within the season because of the degradable materials used in their construction. The technology was adopted by the Lewis and Clark era mountain men fur traders for developing transportation, in lieu of horses, for floating furs eastward toward the Mississippi River and at times to escape inhospitable Indians. Bullboats were made of several freshly killed bull buffalo skins which were stretched around and tied to a hemispherically shaped assemblage of saplings cut from along the stream or river, then dried over a fire to reduce hull flex and to shrink-wrap the sapling skeleton. The antiflex air-bladder to reduce hull flex, as implemented in the present invention, replaces the Indian heat drying and smoking buffalo skin hull stiffening process. Tensioning of the skin by pressurizing the antiflex air-bladders replaces the Indian heat-shrinking process and the hull skin and framework should last season after season. The intent of this design is to revive awareness of such boats and their traditions while creating a fun craft. Its design is straightforward using the structure and methodology of the present invention.

3. Drift Boat or Dory

Being built to handle rough ocean waves and conditions, dories have been used for centuries as coastal fishing boats and only within the past half century have they been adapted for widespread use on inland US rivers. A drift boat is a dory modified to accommodate stream fishermen who would rather ride than wade. They have become quite common on our western rivers. The folding design shown in FIGS. 9.5*a* and 9.5*b* provides a low cost, lightweight, conveniently storable, easily transportable drift boat for fishermen, particularly those from populated eastern urban areas, who would love to row on fish-filled western rivers. This embodiment introduces the antiflex stringers, essentially a bridge construction technique which you can see often along our highways, adapted to folding boats. The presence of these members in the drift boat created the need for the universal grasp connectors which are used throughout the side of the boat as seen in the diagram. The other connectors used have already been introduced by use in previous examples.

4. Kayak

FIGS. 9.6*a* and 9.6*b* show two views of an isoskeleton of a kayak. It consists of a plurality of floor and side stringers fastened to a relatively rounded and recurved stem section. Stringers, equivalent to gunwales on a canoe, on the top of the kayak, provide attachment points for transverse and longitudinal elements which comprise the deck of the kayak and the cockpit opening. The hull skin would have an attached antiflex air-bladder flotation system. The hull skin would be slipped over the assembled skeleton and secured with a sliding fastener, and the air-bladder would be inflated bringing the hull skin in tension with the skeleton and providing flotation and longitudinal hull flex reduction. This boat demonstrates that it is easily within the technology limits of the present invention to build a deck onto the top of a variation of the preferred embodiment thereby turning it into a kayak.

5. Adirondack Guide Boat

The Adirondack Guide Boat is a comparatively lightweight, and very fast rowboat developed in the Adirondack mountains of New York State. The construction of this alternate embodiment of the preferred embodiment entails only minor modification of the basic embodiment of a canoe. In the guide boat in the figure the only new feature, a minor design modification, is the stem brace to which some of the stringers are attached. This is done to assure a long narrow keel section at the bow and stern, and a sharp entry line to the stems to "cut through" the water.

6. Alternate Embodiments of the Canoe Isoskeleton.

FIGS. 9.8*a,* 9.8*b,* 9.8*c,* and 9.8*d* show alternate embodiments of a canoe which employ variations in the manner in which antiflex stringers are implemented. FIGS. 9.8*c* and 9.8*d* show an alternate embodiment of a canoe with a double keel structure and bifurcated stems.

1. Other Mounting Embodiments of Connectors.

Of first note is that the various connectors can be mounted differently. Such mountings may be by a stud mount, a cap mount, a bore sleeve mount, a channel mount, and a disc mount among others. They may be mounted in-line or offset, and with parallel or normal (perpendicular) orientations. This gives them far broader versatility. Some of these alternate mounting methods are used in alternate embodiments of the invention. Of second note, the shockfloor has alternate embodiments one of which is having fabric laminated to both sides of the foam in order to increase strength and provide a fire retardent surface on both sides of the foam, if the foam chosen is itself not fire retardent. Canoes, with plastics present in many modern models, excepting metal parts present, completely vanish when set afire.

2. Other Embodiments of an Antiflex Air-bladder System.

Other embodiments using various combinations of foams, fabrics and air-bladders are: 1) tri-laminate on bottom, with mono-layer fabric on inner and outer sides of hull forming the air bladder integral with the hull; 2) tri-laminate throughout the boat including tri-laminate forming the inner and outer sides of the hull skin forming a sealed bladder integral with the hull; 3) tri-laminate throughout the boat including tri-laminate forming the inner and outer sides of the hull skin forming an envelope for insertion of a separate removable air bladder; 4) tri-laminate on bottom and outer sides of hull, with mono-layer fabric on inner side of hull forming a sealed air bladder integral with the hull; and 5) tri-laminate on bottom and outer sides of hull combined with a mono-layer fabric on inner side of hull forming an envelope for insertion of a separate removable air bladder.

3. Materials and Construction of an Isoskeleton.

Throughout the various embodiments of the invention, tubular skeletal members made of aluminum were used because of its ready availability and low cost. This in no way should be construed to be a constraint or limitation on the nature of either the cross-sectional shape of the skeletal members (a cross section of a tube is a circle) or of the material from which they are made. For example, as an alternative shape and material, the inventor has created designs for semi-rigid flattened members molded from any suitable elastomer which has both strength, elasticity and suitable durability under adverse use and weather conditions, and which has the various connectors molded as part of members themselves rather that as separate connectables. This includes the stems, the stingers, the keel, the gunwales, the formers and all other members introduced in the alternate embodiments or in new designs.

By this point the reader can see that through the use of the elements of the invention and methodology that a wide variety of watercraft can be designed and built rather quickly and inexpensively. Through various combinations and with the various embodiments of its hull-stiffening antiflex airbladder and flotation system; hull-stiffening antiflex stringers; side stringers, and the various alternate embodiment mountings of isoconnectors, lockconnectors, universal grasp connectors, wing fasteners, strap fasteners, gunwale terminator fastener and side stringer fastener; with the use of stringers comprising in-line spacers, end spacers, and shock cord, with a isotropically secure skeletal interior frame, and a shock and abrasion resistant shockfloor, a wide variety of watercraft can be designed and built. Some may employ all the above elements, some may employ a subset of the elements of the invention, and still others may employ a different subset of the elements as seen in the alternate embodiments.

It can be appreciated from the above that this technology can be adapted to building lightweight, collapsible ice-shanties, backyard swimming pools, backyard utility sheds, frameworks for bookshelves, connectors for assembling furniture, and house frames, connecting parts of children's toys together, tree shacks, bird houses, connectors for plumbing and electrical conduit piping, scaffolding for painters and window washers, dog houses, clothes lines, automotive hose clamps, cross-link fencing connectors, backpack strap fasteners and on-the-ground tents for both civilian and military use, and tents for the back of pickup trucks, solar panel installation, cat and dog leashes and collars, horse bridles.

This invention also relates to a canoe chair or saddle that is generally flat-folding, portable, adjustable, ergonomically designed, multi-position, and multi-functional which adapts to the sitting arid kneeling positions, arid which can be adjusted for use as a portage yoke.

Prior to the advent of the popularity of canoeing, which has soared in the past several decades, the types of canoe seats available were limited to the traditional "straight board" or planar type arrangement wherein a generally straight flat surface is supported at appropriate posit ions in the canoe, that being the bow, the stem arid/or amidships. It was typically supported from gunwale level, by attachment at the underside of the gunwale. The seat was often made more comfortable by the use of a woven material such as polyester, organic fiber weaves, or padded with closed cell waterproof foam. More frequently seen, particularly in long distance traveling canoes were seats containing a bucket contour for receiving the buttocks of the paddler. This arrangement is reputed to be more comfortable on long trips than a straight board arrangement.

Some of these seats were adjustable to positions from fore-to-aft of the amidships position, for trimming the canoe during use., as desired. This usually accomplished by fitting the planar seat into a sliding mount arrangement such that it can be positioned farther toward the bow or farther toward the stern of the craft for improved trim. In one case it is also adjustable to port and to starboard for 360 degrees of trimming capability. Such seats are not otherwise adjustable.

Most seats are limited in that, after the time of initial installation, they are not adjustable for alternating between the sitting or kneeling positions, or they do not incorporate any other function such as serving as a yoke for portaging the craft or carrying it between the motorized transportation vehicles and the water. Several exceptions with limitations exist. For example, one arrangement has placed amidships a planar seat having an indent which services as a portage yoke. Another arrangement, e.g. saddles as canoe seats, tend to be ergonomically designed for a single paddling position and are useful for specialized use in whitewater, but are not practical for all-around canoeing use and none are quickly and easily adjustable for multi-function purposes.

It is therefore an object of the present invention to overcome the disadvantages of the prior art and provide a canoe chair or seat that has a lightweight relatively flat-folding, portable adjustable, ergonomically designed, multi-position, multi-finction chair which adapts to the sitting and kneeling paddling positions, and which can be adjusted for use as a portage yoke.

It is also an object of the invention to provide a canoe chair in which the various positions of the seat can be changed using only one hand, while the paddler straddles the seat in a matter of seconds and which, furthermore, can be positioned and used in the bow, the stern, or anywhere between such extremes.

A multi-function/positioned chair for a watercraft which can be adjusted as between sitting, kneeling, and portaging positions, comprising a seat which contains a front, rear, top and bottom sections, a means for supporting the canoe on the front section of said seat when portaging, including a first pivot means attached at said front section at the bottom seat and proximate to said portage support means, an adjustment arm attached to said first pivot means, a second pivot means attached to the rear section of the seat, a first leg affixed to said seat at said second pivot means and extending downwardly and under the front section of said seat, a second leg attached to said second pivot means extending downwardly and under the seat under the rear section of said seat, characterized in that the first and second pivot means are selectively disposed relative to one another, and the lengths of the first and second leg are adjusted such that the chair can be positioned as between a sitting, kneeling or portaging position.

THE MULTI-FUNCTION CANOE CHAIR

Figure 10:
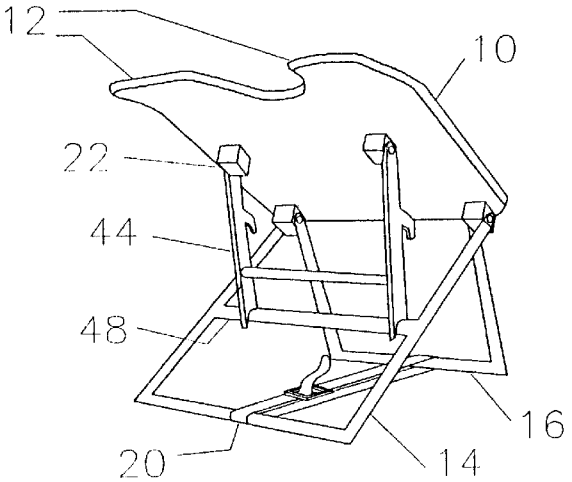
FIG. 10 is a perspective elevated view of a multi-position canoe chair/portage-yoke.
Figure 11:
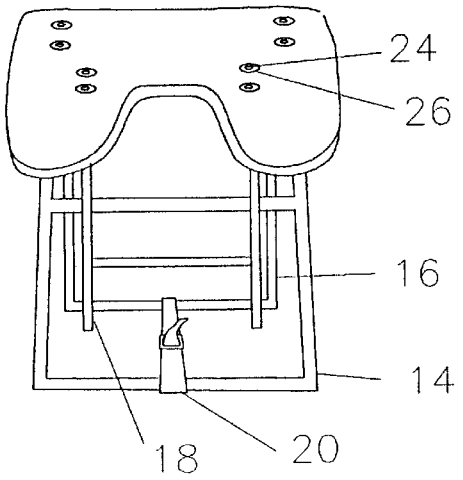
FIG. 11 is a front elevated view of a canoe seat of FIG. 10.

The present invention comprises, in one embodiment, a folding, multi-function canoe chair with a plurality of seat positions, shown in the perspective view in FIG. 10 and in the front elevated view of FIG. 11. It comprises a seat 10 with a built in portage yoke 12, a front leg 14, a rear leg 16, an adjustment arm 18, a strap 20 and a plurality of box pivot connectors 22 with associated bolts, washers and pins as a means for attaching the arm and legs to the seat. The strap maintains the proper boat floor-level spacing between the front and rear legs, keeping them from separating under the action of a load force.

Figure 14:
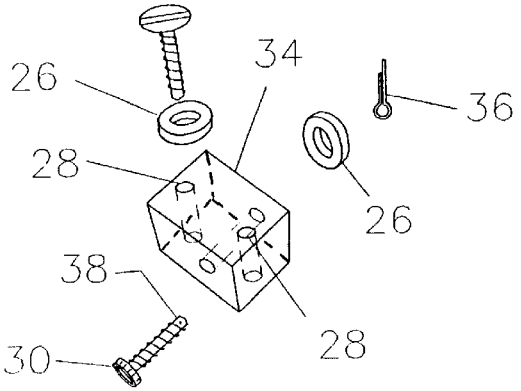
FIG. 14 is enlarged exploded view detailing the box pivot connector.
Figure 15:
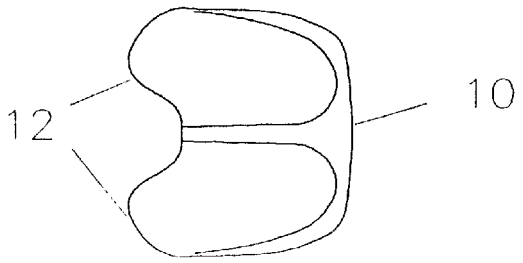
FIG. 15 is a top view of the preferred shape of the canoe seat of FIG. 10.
Figure 16:
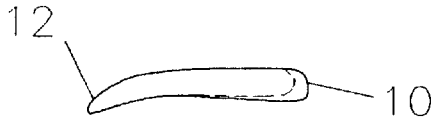
FIG. 16 is a side view of the seat shown in FIG. 15.

As seen in FIGS. 10 and 11 each of the four box connectors are secured by two carriage bolts 24 and two washers 26 to the seat 10. As seen in FIG. 14, the carriage bolts are threaded into the bore sleeves 28 after passing through a bore in the seat to effect the attachment of the seat to the box connectors.

Figure 12:
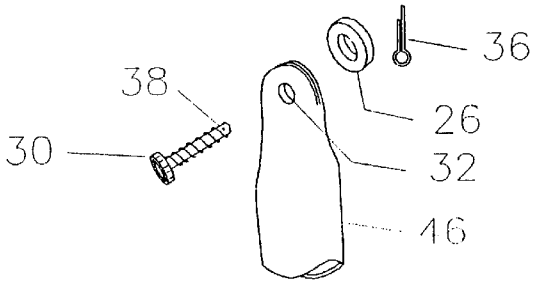
FIG. 12 is a fragmentary perspective exploded view of the seat connection extremity of the chair front and/or rear legs of FIGS. 10 and 11.
Figure 13:
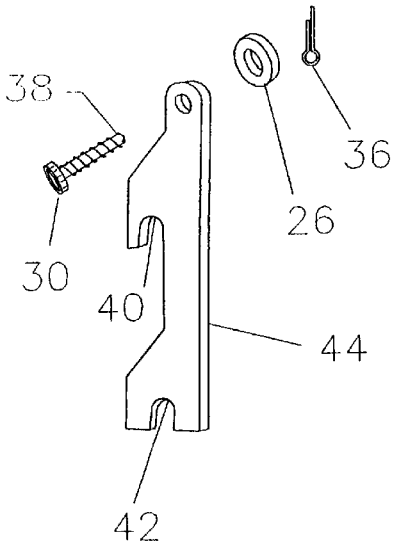
FIG. 13 is an exploded fragmentary view of the adjustment arm detailing, the adjustment leg.

Looking at FIGS. 12 and 13 both the front and back legs are attached to the seat by means of a finger bolt 30, which is passed through the bore sleeve 32 of the leg, thence through the box pivot connector 34, as seen in FIG. 14, being secured by a pin 36 passed through the pin sleeve 200 of the finger bolt. The washer reduces friction when the leg is allowed to pivot relative to the box connector.

Figure 17:
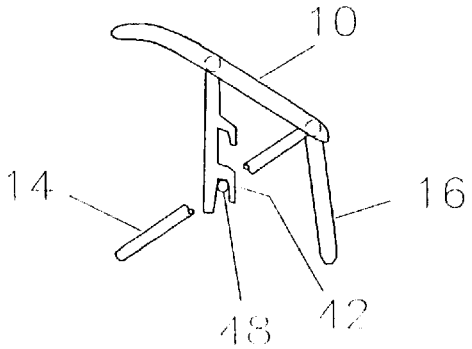
FIG. 17 is a fragmentary elevated side view of the portage configuration of the canoe chair of FIG. 10.
Figure 18:
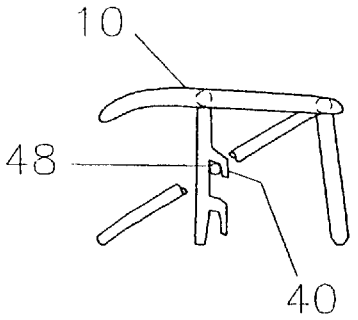
FIG. 18 is a fragmentary side view of the sitting configuration of the canoe chair of FIG. 10.
Figure 19:
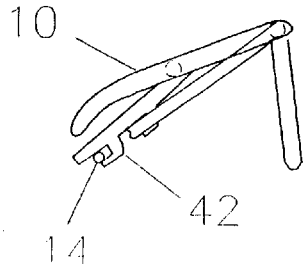
FIG. 19 is a fragmentary elevated side view of the kneeling configuration of the canoe chair of FIG. 10.

The catch positions 40 and 42 as shown in FIG. 13 on the adjustment arm legs 44 in combination with the horizontal section of the front leg 46 and the cross bar 48 provides the means for multi-purpose functionality by adjusting to positions for portaging, sitting, and kneeling. Looking at FIG. 17 the portage position and configuration of the adjustment arm is shown. In this configuration the arm is positioned such that the lower catch 42 engages the cross bar 48 of the arm. In FIG. 18, engagement of the upper catch 40 on the cross bar accomplishes the sitting configuration of the seat. The kneeling position configuration is accomplished by engagement of the lower catch on the horizontal part of the leg which is in contact with the floor.

The chair is preferably attached to the floor. As a method of attachment of the chair to the floor, D-rings could be attached to the floor in a hard-hulled boat and straps with fasteners or buckles attached could be run over the chair legs at the four corners and secured to the D-rings. The straps could be secured directly to the formers and/or stringers in a folding boat at floor level. If the chair is securely attached to the floor in the above manner, the strap 20 of FIG. 10 running from the front to the rear leg may not be required.

The basic embodiment described hereinafter is one alternative of the multifunction. multi-position canoe seat of the present invention. Some alternate embodiments are described hereinbelow. All such embodiments can be made lightweight and flat-folding for convenient storage and transport, and can be adjusted quickly to various seat positions. All can be attached to the floor of the boat and all use a strap or similar means running from the front to the chair to the back of the chair nearest the water level or bottom of the boat.

Figure 30:
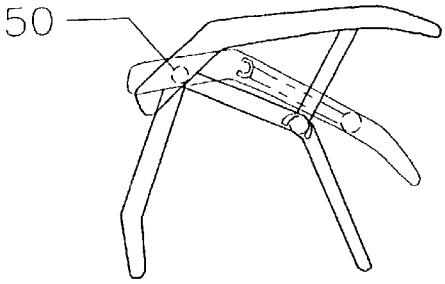
FIG. 30 is an elevated side view of alternate embodiment H of a multi-function canoe chair.
Figure 31:
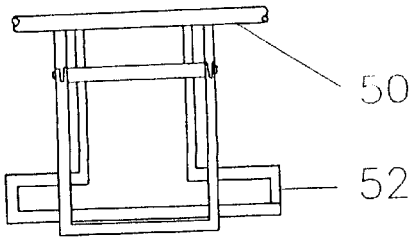
FIG. 31 is a fragmentary view of tile chair of FIG. 30 with the seat removed.
Figure 32:
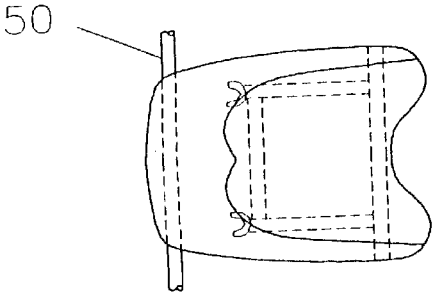
FIG. 32 is a top view of the preferred shape of the canoe seat of FIG. 30.
Figure 33:
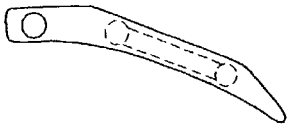
FIG. 33 is a side view of the seat shown in FIG. 21.

Those skilled in the art will recognize that the embodiments disclosed herein could be easily modified to accommodate a greater number or a fewer number of seat configurations than the ones shown. In most cases this means adding or subtracting cross-bars from the designs shown. A still further general modification to these designs would provide for a thwart to be passed through the chair for more solid anchorage to the boat which may also permit elimination of the rear leg of the chair. This thwart could provide a convenient pivot point for seat orientation between the carrying, sitting and kneeling positions. An illustrated example of such a use of a thwart 50 is shown in FIGS. 30, 31 and 32.

FIGS. 10 through 33 (hereinafter described as embodiments A through H) inclusively show at least alternative eight embodiments of canoe chairs which provide for the functions of portaging, sitting and kneeling. The embodiment shown in FIG. 30 provides the three functions with just two seat positions; embodiment G shown in FIG. 29 differs from al the other embodiments in that it employs a sliding device attached to the underside of the seat to which the front leg is attached and is thus continuously adjustable for seat position between the kneeling and portaging positions for more than three positions. In each of the following alternative embodiments. B through G. multiple seat positions have been consolidated onto one drawing for economy of presentation. A description of these alternate embodiments of a multifunction canoe chair follows:

Alternative Embodiment A

Figure 20:
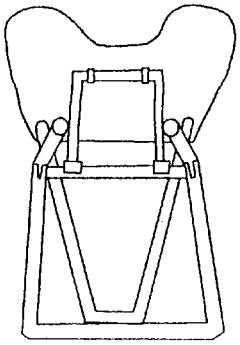
FIG. 20 is a front elevated view of alternative embodiment A of a multi-function canoe chair.
Figure 21:
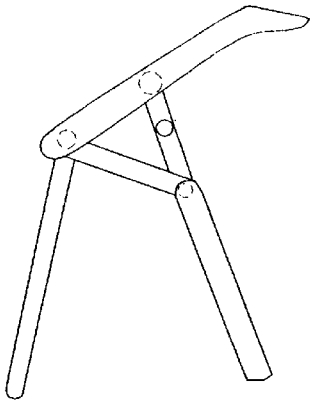
FIG. 21 is a fragmentary elevated side view of the portage configuration of the canoe chair of 20.
Figure 22:
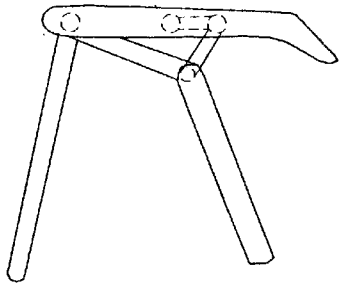
FIG. 22 is a fragmentary elevated side view of the portage configuration of the canoe chair of FIG. 20.
Figure 23:
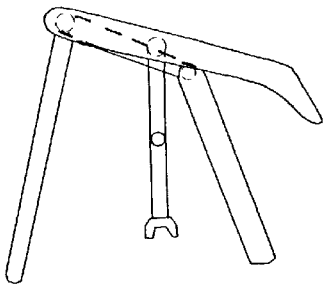
FIG. 23 is a fragmentary elevated side view of the portage configuration of the canoe chair of FIG. 20.

FIGS. 20. 21, 22 and 23 show a canoe chair wherein the adjusting arm itself folds near the center-point of its adjustment arm leg in order to effect a change of configuration from the portage position, as shown in FIG. 21, to the sitting position s shown in FIG. 22. The kneeling position is accomplished by allowing the adjustment arm to hand free from its base-connection to the seat as seen in FIG. 23. The front leg also folds near at the position of its crossbar.

Alternative Embodiment B

Figure 24:
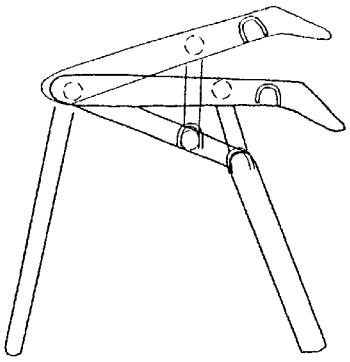
FIG. 24 is an elevated side view of alternative embodiment B of a multi-function canoe chair.

FIG. 24 shows a canoe chair which parallels the architecture of alternate embodiment A, except that its adjustment arm is not jointed near its center. The adjustment arm is connected at its base to the underside of the seat and utilized two cross-bars on the front leg to effect the portage and sitting positions but which hangs free to effect the kneeling position. An alternate catch, attached to the underside of the seat, effects securing of the seat into the kneeling position. The front leg of this embodiment folds at the cross-bar.

Alternate Embodiment C

Figure 25:
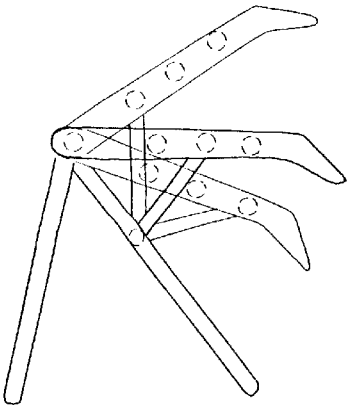
FIG. 25 is an elevated side view of alternate embodiment C of a multi-function canoe chair.

FIG. 25 sows a canoe chair in which the base-connection of the adjustment arm is on a cross-bar of the front leg. The various positions of the seat are accomplished by adjusting the position of the upper or seat end, of the adjustment arm, the different positions on the underside of the seat, and by snapping it into a secure position there.

Alternative Embodiment D

Figure 26:
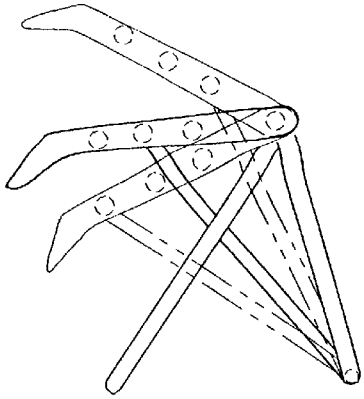
FIG. 26 is an elevated side view of alternate embodiment D of a multi-function canoe chair.

FIG. 26 shows a canoe chair in which the base-connection of the adjustment arm is on the horizontal portion of the rear leg nearest the floor of the boat. The various positions of the seat on the chair are accomplished by varying the position of the seat-end or upper end of the adjustment arm to different positions on the underside of the seat and securing it thereto.

Alternate Embodiment E

Figure 27:
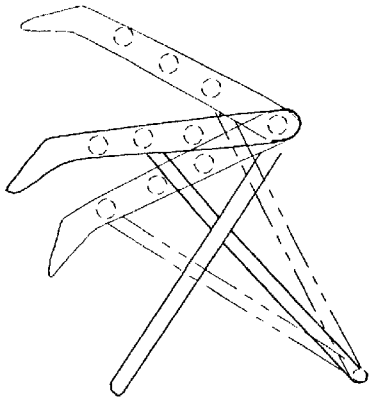
FIG. 27 is an elevated side view of alternate embodiment F of a multi-function canoe chair.

FIG. 27 shows a canoe chair in which the rear leg also functions as the adjusting arm. The adjusting arm engages the bottom side of the seat as in embodiment described hereinabove.

Alternative Embodiment F

Figure 28:
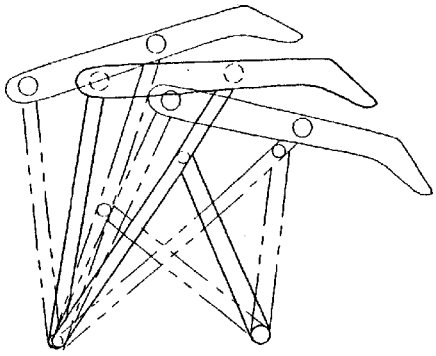
FIG. 28 is an elevated side view of alternate embodiment F of a multi-function canoe chair.

FIG. 28 shows a canoe seat in which the adjustment arm is a separate piece, which is not attached to the rest of the chair, except at the variable point of engagement for seat positioning. It serves as the adjustment arm. The front and rear legs are affixed to the bottom of the seat and to each other at floor level and are fixed, in position, to each other and to the seat. The seat, along with the front and rear legs, pivots as a unit to the various functional positions. The adjustment arm accomplishes the various functional positions by pivoting on its lower extremity at floor level and engaging separate cross-bars affixed to the front leg.

Alternative Embodiment G

Figure 29:
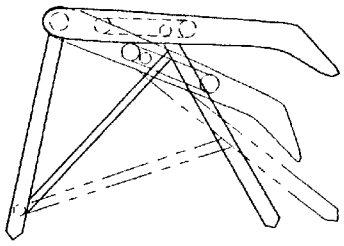
FIG. 29 is an elevated side view of alternate embodiment G of a multi-function canoe chair.

FIG. 29 shows a canoe chair which differs fundamentally from all the other embodiments listed in that it employs a sliding adjustment mechanism, a pivot, a strap to accomplish the various seat positions, and is continuously adjustable. The sliding mechanism is rigidly attached to the underside of the seat. The cross-bar at the juncture of the adjustment arm and the front leg serves as pivot for accommodating the changing orientations of the adjustment arm and the front leg. The various functional positions of the seat are accomplished by the combined action this pivot in harmony with the sliding mechanism of the seat. A strap running from the front leg to the back leg is loosened to accommodate the changing positions of the seat then is again fastened at the desired seat positions for final engagement.

Alternative Embodiment H

FIG. 30 shows a two position canoe chair wherein the sitting position is accomplished while the seat is adjusted to the kneeling position. To sit on it the paddler slides to the rear of the seat and sits on the back of it. As can be seen from FIGS. 32 and 33 the seat is shaped to facilitate both the sitting and kneeling functions. The adjusted position of the seat serves as the portage configuration. The chair has a thwart running through the pivot point of the seat. The opposite ends of the thwart would be rigidly affixed to the sides of the boat. Just above floor level on the lower portions of the rear leg is a toe-brace 52 for the paddler's feet. The chair could be made to be used with a thwart or without a thwart as a stand-alone chair, in a convertible fashion, at the option of the boat owner.

Alternate Embodiment I

Figure 34:
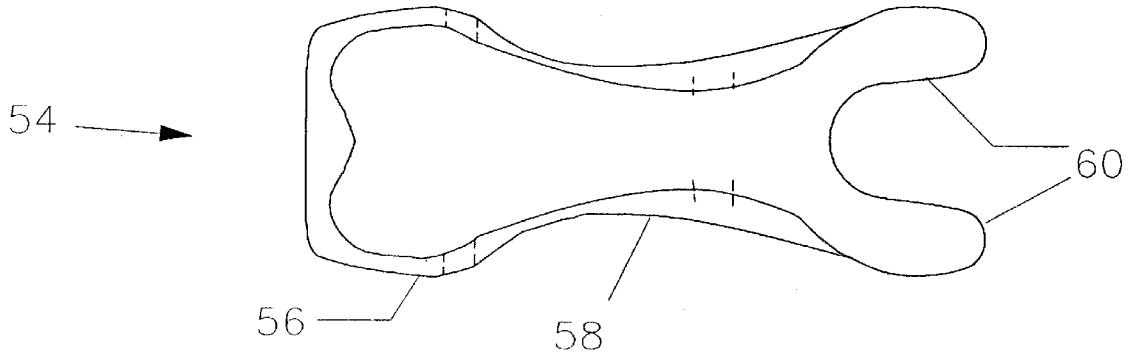
FIG. 34 is a top view of the multi-position canoe saddle embodiment.
Figure 35:
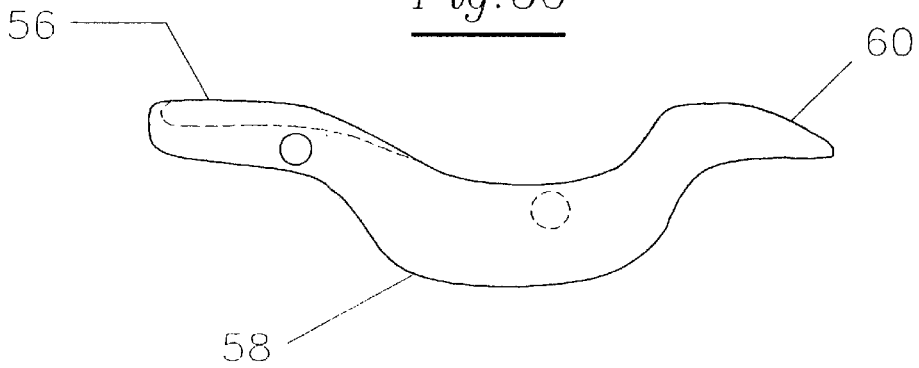
FIG. 35 is a side view of the canoe saddle embodiment.
Figure 36:
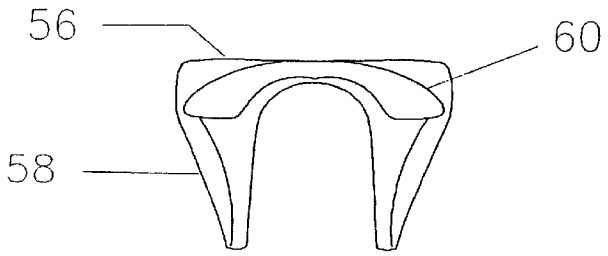
FIG. 36 is a front view of the canoe saddle embodiment.

FIGS. 34–36 illustrate the alternative embodiment of the present invention in connection with a canoe saddle. That is, as shown in FIG. 34, the chair seat can be conveniently replaced by a saddle seat configuration 54. More specifically illustrated in FIG. 35, the saddle contains a seat portion 56, saddle portion 58 and portage yoke region 60. These portions therefore provide a seat portion for sitting and for comfort, the saddle is for whitewater action, and the yoke portion is for portaging. In accordance with the present invention, when the saddle seat as shown replaces the chair seat shown in earlier FIG. 21, various positions of the saddle can also be obtained. However, unlike the chair seat section which is preferably adjusted as between a sitting, kneeling and portaging position, the saddle seat is preferably adjusted as between two positions; i.e. an upright position for comfort and whitewater action, and a portaging position.

Similarly, alternate embodiments of the invention discussed and or illustrated herein should likewise not be construed to be limitations on the invention, but as a revelation of the breadth of application of the invention to many forms and shapes of folding watercraft not explicitly illustrated or mentioned herein and to the many other potential uses and applications to which the technology can be applied. Accordingly, the scope of the invention should be determined, not by the embodiments illustrated, but by the appended claims and their legal equivalents.

I claim:

1. A collapsible portable boat with enhanced longitudinal rigidity, comprising:

a skeleton frame and hull, said hull comprised of flexible material, including at least one end stem section, and gunwales connected to each other by a gunwale connector, and lengthwise support stringers disposed along the length of the boat along the bottom and sides of the boat and support formers arranged transverse to said lengthwise support stringers;

a floor section affixed to that portion of the hull section which defines the bottom of the boat which floor section is disposed as between the stingers and the flexible material of the hull; and an inflatable tensioner for tensioning as between said skeleton structure and the outer flexible hull positioned as between the flexible material of the hull and said lengthwise support stringer, wherein said inflatable tensioner comprises at least two inflated air bladders stacked upon one another, positioned between the hull and said support stringers, wherein at least one of said lengthwise support stringers is disposed lengthwise along that portion of said air bladders where said air bladders are stacked and wherein said air bladders are of greater cross-sectional area than said stringers and formers, wherein said tension substantially reduces longitudinal hull flex further characterized in that said inflatable tensioner for tensioning as between said skeleton structure and outer flexible hull is itself retained by said support stringer such that said inflatable tensioner will not substantially reposition itself relative to said stringer when said canoe is exposed to a longitudinal hull flex.

2. The collapsible boat of claim 1, including a side stringer running lengthwise along the entire length of said air bladders.

3. The collapsible boat of claim 1 wherein the skeleton frame includes a side stringer running along the length of the boat and attached to the end stem section.

4. The collapsible boat of claim 1, wherein said floor section comprises a foam material.

5. The collapsible boat of claim 1 wherein the gunwales and formers are connected to one another by a connector.

6. The collapsible boat of claim 5 wherein said connector locks said gunwales and formers in substantially all directions other than the return path by which they were connected.

7. The collapsible boat of claim 1, further including a former-stringer connector for connecting a former to a stringer.

8. The collapsible boat of claim 7 wherein said former-stringer connector disposes said former on top of said stringer with regards to location of water when the boat is in use.

9. The collapsible boat of claim 8 wherein said former-stringer connector locks said former to said stringer.

10. The collapsible boat of claim 1, further including a connector to connect said stringers disposed along said bottom of the boat to said end stem section.

11. A collapsible portable boat with enhanced longitudinal rigidity, comprising:

a skeleton frame and hull, said hull comprised of flexible material and containing sidewalls and a floor section, including at least one end stem section, and gunwales connected to each other by a gunwale connector and lengthwise stringers disposed along the length of the boat along the bottom and sides of the boat and support formers arranged transverse to said lengthwise stringers;

wherein said floor section is affixed to that portion of the hull section which defines the bottom of the boat said floor section disposed as between the stringers and the flexible material of the hull, and a tensioner for tensioning positioned as between said sidewall of said hull and said lengthwise support stringer characterized in that said tensioner is greater in cross-sectional area than said stringers and formers and wherein said tensioning substantially prevents longitudinal hull flex further characterized in that said tensioner for tensioning as between said skeleton structure and outer flexible hull is itself retained by said support stringer such that said tensioner will not substantially reposition itself relative to said stringer when said canoe is exposed to a longitudinal hull flex.

12. The collapsible boat of claim 11, including a side stringer running lengthwise along the entire length of said tensioner.

13. The collapsible boat of claim 11 wherein the skeleton frame includes a side stringer running along the length of the boat and attached to the end stem section.

14. The collapsible boat of claim 11, wherein said floor section comprises a foam material.

15. The collapsible boat of claim 11 wherein the gunwales and formers are connected to one another by a connector.

16. The collapsible boat of claim 15 wherein said connector locks said gunwales and formers in substantially all directions other than the return path by which they were connected.

17. The collapsible boat of claim 11, further including a former-stringer connector for connecting a former to a stringer.

18. The collapsible boat of claim 17 wherein said former-stringer connector disposes said former on top of said stringer with regards to location of water when the boat is in use.

19. The collapsible boat of claim 18 wherein said former-stringer connector locks said former to said stringer.

20. The collapsible boat of claim 11, further including a connector to connect said stringers disposed along said bottom of the boat to said end stem section.

21. A collapsible portable boat with enhanced longitudinal rigidity, comprising:

a skeleton frame and hull, said hull comprised of flexible material, including at least one end stem section, and gunwales connected to each other by a gunwale connector, and lengthwise support stringers disposed along the length of the boat along the bottom and sides of the boat and support formers arranged transverse to said lengthwise support stringers;

a floor section affixed to that portion of the hull section which defines the bottom of the boat and which floor section is disposed as between the stringers and the flexible material of the hull; and an inflatable tensioner for tensioning as between said skeleton structure and the outer flexible hull positioned as between the hull and support stringers, characterized in that the tension substantially reduces hull flex, and wherein the end stem section contains an end stem connector for connecting and securing the gunwale connector in said end stem section, further characterized in that said tensioner for tensioning as between said skeleton structure and outer flexible hull is itself retained by said support stringer such that said tensioner will not substantially reposition itself relative to said stringer when said canoe is exposed to a longitudinal hull flex.

22. The collapsible boat of claim 21 wherein said end stem connector for connecting and securing the gunwale connector in said end stem section is a jaws-shaped connector, with an open section thereof for receiving the gunwale connector.

23. The collapsible boat of claim 21 wherein said end stem connector further includes a strap for locking said gunwale connector to said end stem section.

24. The collapsible boat of claim 21, including a side stringer running lengthwise along the entire length of said inflatable tensioner.

25. The collapsible boat of claim 21 wherein the skeleton frame includes a side stringer running along the length of the boat and attached to the end stem section.

26. The collapsible boat of claim 21, wherein said floor section comprises a foam material.

27. The collapsible boat of claim 21 wherein the gunwales and formers are connected to one another by a connector.

28. The collapsible boat of claim 27 wherein said connector locks said gunwales and formers in substantially all directions other than the return path by which they were connected.

29. The collapsible boat of claim 21, further including a former-stringer connector for connecting a former to a stringer.

30. The collapsible boat of claim 29 wherein said former-stringer connector disposes said former on top of said stringer with regards to location of water when the boat is in use.

31. The collapsible boat of claim 30 wherein said former-stringer connector locks said former to said stringer.

32. The collapsible boat of claim 21, further including a connector to connect said stringers disposed along said bottom of the boat to said end stem section.

33. A collapsible portable boat with enhanced longitudinal rigidity, comprising:

a main skeleton frame and hull, including at least one end stem section, and gunwales connected to each other by a gunwale connector, further characterized in that the hull is of flexible material and lengthwise support stringers are disposed along the length of the boat along the bottom and sides of the boat and support formers are arranged transverse to said lengthwise support stringers, wherein the end stem section contains a connector for connecting and securing the gunwales connector to said end stem section, a floor section affixed to that portion of the hull section which defines the bottom of the boat and which is disposed as between the stringers and the flexible material of the hull, characterized in that the support stringers themselves comprise a plurality of sectional support elements which are affixed to one another by tension; and a tensioner for developing tension as between said skeleton frame and the outer flexible hull positioned as between the flexible material of the hull and the skeleton, characterized in that the tensioner for tensioning as between said skeleton structure and outer flexible hull is itself retained by said support stringers such that said tensioner will not substantially reposition itself relative to said stringer when said canoe is exposed to a longitudinal hull flex.

34. A multi-function/positioned chair or saddle for a watercraft which can be adjusted as between sitting, kneeling and portaging positions, comprising a seat which contains a front, rear, top and bottom sections;

a portaging support on the front section of said set for supporting the seat when used as a portage yoke wherein the portaging yoke comprises a cut-out section; and a supporting framework connected to said seat, said supporting framework comprising a first and second leg member pivotally attached at the rear of said seat, wherein said first and second leg member are substantially disposed in use in the form of an inverted V, and a third leg member pivotally attached to said seat wherein said third leg member can support said second leg member to thereby position said seat in a sitting, kneeling or portaging position.

* * * * *

UNITED STATES PATENT AND TRADEMARK OFFICE

CERTIFICATE OF CORRECTION

PATENT NO. : 5,964,178

DATED : October 12, 1999

INVENTOR(S) : Gonda

It is certified that error appears in the above-identified patent and that said Letters Patent is hereby corrected as shown below:

Col. 33, line 46, please insert --as between the flexible material of the hull and the skeleton, wherein said inflatable tensioner is positioned-- before "as between".
Col. 34, line 43, please insert --tension substantially prevents longitudinal hull flex further characterized in that said-- before "tensioner for tensioning".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*